US009126404B2

(12) United States Patent
Kido

(10) Patent No.: US 9,126,404 B2
(45) Date of Patent: Sep. 8, 2015

(54) INK JET RECORDING APPARATUS AND METHOD FOR DETECTING FAULTY DISCHARGE IN INK JET RECORDING APPARATUS

(71) Applicant: CANON KABUSHIKI KAISHA, Tokyo (JP)

(72) Inventor: Hideyuki Kido, Isehara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/019,929

(22) Filed: Sep. 6, 2013

(65) Prior Publication Data

US 2014/0002527 A1 Jan. 2, 2014

Related U.S. Application Data

(63) Continuation of application No. 13/213,376, filed on Aug. 19, 2011, now Pat. No. 8,562,099.

(30) Foreign Application Priority Data

Aug. 31, 2010 (JP) ..... 2010-193574

(51) Int. Cl.

| | |
|---|---|
| ***B41J 29/393*** | (2006.01) |
| ***B41J 2/07*** | (2006.01) |
| ***B41J 2/045*** | (2006.01) |
| ***B41J 2/21*** | (2006.01) |
| ***B41J 11/00*** | (2006.01) |

(52) U.S. Cl.

CPC *B41J 2/07* (2013.01); *B41J 2/0451* (2013.01); *B41J 2/2139* (2013.01); *B41J 2/2142* (2013.01); *B41J 2/2146* (2013.01); *B41J 11/0065* (2013.01)

(58) Field of Classification Search

CPC ..... B41J 2/0451; B41J 2/165; B41J 2/16579; B41J 2/2139; B41J 2/2142; B41J 2029/3935; B41J 29/393; B41J 29/42

See application file for complete search history.

(56) References Cited

U.S. PATENT DOCUMENTS

2007/0153035 A1* 7/2007 Jung et al. ..... 347/9

FOREIGN PATENT DOCUMENTS

JP 2010-036452 A 2/2010

* cited by examiner

*Primary Examiner* — Geoffrey Mruk

(74) *Attorney, Agent, or Firm* — Canon USA, Inc. IP Division

(57) ABSTRACT

A faulty discharge detection technique to detect faulty discharge of nozzles in an ink jet recording apparatus includes recording a test pattern onto a recording medium so as to include at least two or more reference marks in the width direction of the recording medium, reading the test pattern by a scanner unit, determining whether or not there is a faulty discharge image from image data read in the test pattern reading, and calculating faulty discharge nozzle position to, in the event that there is a faulty discharge image in the image data, detect the reference marks and detect the position of nozzles in a faulty discharge state from the position of the faulty discharge image in the image data.

12 Claims, 13 Drawing Sheets

INK JET RECORDING APPARATUS AND METHOD FOR DETECTING FAULTY DISCHARGE IN INK JET RECORDING APPARATUS

CROSS-REFERENCE TO RELATED APPLICATION

This application is a Continuation of U.S. application Ser. No. 13/213,376, filed Aug. 19, 2011, which claims the benefit of Japanese Patent Application No. 2010-193574 filed Aug. 31, 2010, which is hereby incorporated by reference herein in its entirety.

BACKGROUND OF THE INVENTION

1. Field of the Invention

Embodiments of the present invention relate to a technique for detecting faulty discharge at nozzles of an ink jet recording apparatus which performs recording by discharging ink droplets from the nozzles, and to an ink jet recording apparatus which may perform recording without using nozzles in a faulty discharge state.

2. Description of the Related Art

There are known ink jet recording apparatuses which use the ink jet method, as apparatuses for performing printing recording on recording media such as recording sheets and film and the like. An ink jet recording apparatus is capable of being mounted with a recoding head where there are arrayed nozzles for discharging ink droplets, in accordance with the resolution of the images to be recorded. Characters and images may be recorded in the recording medium by discharging ink droplets from the nozzles while the recording medium is being transported, and fixing the ink droplets on the recording medium.

In recent years, there has been proposed a full-line ink jet recording apparatus capable of high-speed recording. A full-line ink jet recording apparatus has a recording head with nozzles disposed over a width of a direction intersecting the recording medium conveyance direction of the recording medium (hereinafter referred to as "recording medium width"), or wider.

With an ink jet recording apparatus of which the width of the recording head is smaller than the recording medium width, ink droplets are discharged while scanning the recording head in the direction of the recording medium width, and the recording medium is conveyed in the recording medium conveyance direction by a predetermined amount each time one scan of the recording head in the recording medium width direction is completed.

There is no need to scan the recording head in the recording medium width direction with a full-line ink jet recording apparatus, so ink droplets may be discharged on the recording medium while continuously conveying the recording medium. As a result, with a full-line ink jet recording apparatus, recording may be performed at higher speeds as compared to an ink jet recording apparatus of which the recording head is smaller than the recording medium width.

The recording head of an ink jet recording apparatus has an ink storage unit for storing ink, and an ink channel communicating between the ink storage unit and the nozzles. The ink channel has provided thereto an energy generating unit which provides discharge energy to the ink, and ink droplets are discharged from the nozzles.

With a recording head having such a configuration, there are cases wherein the ink solidifies within the nozzles in the event of not using for long periods of time, and foreign objects entering the nozzles externally. Also, there are cases wherein bubbles are generated within the nozzles for one reason or another, with the nozzles being filled with bubbles.

In the event that solidified ink, external foreign matter, or generated bubbles plug up the nozzle, this may result in faulty discharge, such as no droplets being discharged from the nozzle or the ink droplets landing on the recording medium at a position other than that intended. Particularly, with full-line ink jet recording apparatuses, the recording head has a width greater than the recording medium width, so the number of nozzles is also great. Accordingly, nozzles with a faulty discharge state (herein after referred to as "faulty discharge nozzles") more readily occur.

In the event of recording characters and images using faulty discharge nozzles, this may also lead to lower quality of the recorded image, so various methods have been proposed for detecting faulty discharge nozzles and alleviating effects on the image quality.

Japanese Patent Laid-Open No. 2006-205742 discloses a faulty discharge detecting method where a test pattern is recorded in a recording medium and faulty discharge nozzles are detected. A scanner unit which reads image data of the image recorded on the recording medium is provided to the ink jet recording apparatus, and faulty discharge nozzles are detected by comparing an image which should be recorded with the image read into the scanner unit, i.e., the actually recorded image.

With the ink jet recording apparatus disclosed in Japanese Patent Laid-Open No. 2006-205742, at the time of detecting a faulty discharge nozzle, a recovery operation is performed to recover from the plugging of the faulty discharge nozzle. Also, nozzles which do not have faulty discharge (called "normal nozzles") perform substitute droplet discharge where these nozzles perform ink droplet discharge instead of the faulty discharge nozzle, thereby alleviating deterioration in quality of the recorded image.

With the faulty discharge detection method disclosed in Japanese Patent Laid-Open No. 2006-205742, the faulty discharge nozzle in the recording head may not be identified from the test pattern image unless the positional relation between the recording medium and the recording head may be determined. With the faulty discharge detection method disclosed in Japanese Patent Laid-Open No. 2006-205742, there has been the need to record the edge portion of the test pattern in the recording medium width direction of the recording medium, in order to comprehend the positional relation between the recording medium and recording head.

However, with a full-line ink jet recording apparatus, the recording head is greater than the recording medium width, so the edge of the test pattern in the recording medium width direction may not be recoded on the recording medium.

Particularly, in the event of performing so-called "borderless printing", there is the need to detect faulty discharge of the nozzles recording the edge portion of the recording medium as well, so it is desirable to perform borderless printing when recording the test pattern as well. As a result, the position relation between the recording medium and the recording head may not be known, so faulty discharge nozzles may not be identified, and recovery operations of the faulty discharge nozzles and substitute droplet discharge at normal nozzles may not be suitably performed.

Now, the position relation between the recording medium and the recording head may be identified from the position of the recording medium and the position of the recording head as to the ink jet recording apparatus, but in this case, conveyance precision of the recording medium and assembly precision of the recording head is a prerequisite, which might lead to increased costs of the ink jet recording apparatus.

SUMMARY OF THE INVENTION

One disclosed aspect of the embodiments provides a faulty discharge detection method for an ink jet recording apparatus, enabling identifying of faulty discharge nozzles even if the edge of a test pattern is not recorded on a recording medium.

One disclosed feature of the embodiments may be described as a process which is usually depicted as a flowchart, a flow diagram, a timing diagram, a structure diagram, or a block diagram. Although a flowchart or a timing diagram may describe the operations or events as a sequential process, the operations may be performed, or the events may occur, in parallel or concurrently. In addition, the order of the operations or events may be re-arranged. A process is terminated when its operations are completed. A process may correspond to a method, a program, a procedure, a method of manufacturing or fabrication, a sequence of operations performed by an apparatus, a machine, or a logic circuit, etc.

According to an aspect of the embodiments, a faulty discharge detection technique detects faulty discharge of nozzles in an ink jet recording apparatus capable of mounting a recording head disposed having nozzles configured to discharge ink onto a recording medium disposed over a length greater than the width of the recording medium in a direction intersecting a recording medium conveyance direction, and including a scanner unit configured to read images recorded by the head. The technique includes: recording a test pattern onto the recording medium using the recording head, the test pattern including at least two or more reference marks disposed in the width direction of the recording medium, the reference marks defining a positional reference between the recording medium and the recording head; reading the test pattern by the scanner unit; determining whether or not there is a faulty discharge image from image data read in the test pattern reading; and calculating faulty discharge nozzle position to, in the event that there is a faulty discharge image in the image data, detect the reference marks and detect the position of nozzles in a faulty discharge state from the position of the faulty discharge image in the image data.

According to one disclosed aspect of the embodiments, faulty discharge nozzles may be identified even if the edge of a test pattern is not recorded on a recording medium.

Further features of the embodiments will become apparent from the following description of exemplary embodiments with reference to the attached drawings.

DESCRIPTION OF THE EMBODIMENTS

An embodiment for carrying out the present invention will now be described with reference to the drawings. Note that the relatively placement of the components of the apparatus, the shape of the apparatus, and so forth, used with this embodiment, are but exemplary, and not restrictive.

Figure 1:
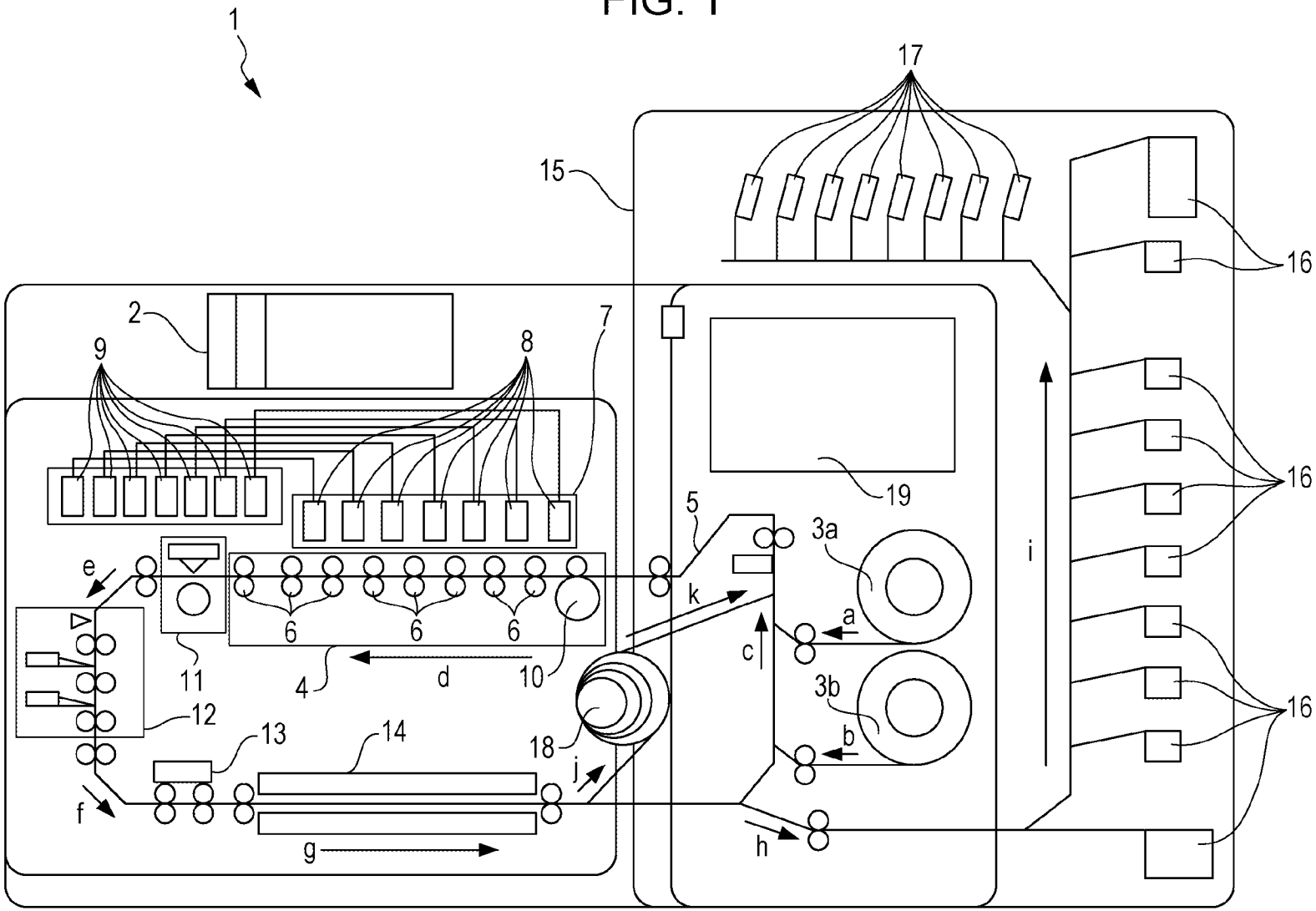
FIG. 1 is a diagram illustrating an example of the schematic configuration of an ink jet recording apparatus to which one disclosed aspect of the embodiments is applicable.

FIG. 1 is a diagram illustrating an example of the schematic configuration of an ink jet recording apparatus to which one disclosed aspect of the embodiments may be applied. As shown in FIG. 1, an ink jet recording apparatus 1 includes a control unit 2, a first cassette 3*a*, a second cassette 3*b*, and a conveying unit 4.

The control unit 2 has built therein a control portion including a controller (including a CPU or MPU), user interface information output device (generating device for display information, audio information, and so forth), and various types of I/O interfaces, and governs various types of control of the overall ink jet recording apparatus 1.

The first cassette 3*a* and second cassette 3*b* store a recording medium 5 on which characters and images are corded by the ink jet recording apparatus 1. The recording medium 5 is stored in the first cassette 3*a* and second cassette 3*b* in a state of a long continuous paper sheet been rolled into a roll. The recording medium 5 stored in the first cassette 3*a* is extracted from the first cassette 3*a* in the direction a in the drawing. The recording medium 5 stored in the second cassette 3*b* is extracted from the second cassette 3*b* in the direction b in the drawing. The recording medium 5 extracted from the first cassette 3*a* or second cassette 3*b* is subsequently conveyed in the direction c in the drawing, and is sent to the conveying unit 4.

The conveying unit 4 has multiple rotational rollers 6 for conveying the recording medium 5, and the conveying unit 4 conveys the recording medium 5 in the direction d in the drawing by rotating the rotational rollers 6 in a predetermined direction.

Also, the ink jet recording apparatus 1 has a recording head unit 7 disposed facing one face of the recording medium 5 passing through the conveying unit 4. The recording head unit 7 is formed so as to be capable of having recording heads 8 for discharging ink mounted thereupon. The number of independently provided recording heads 8 is equal to the number of colors of ink to be discharged (seven colors in the case of the present embodiment), and are held so that the discharge direction of each recording head 8 faces one face of the recording medium 5. Ink droplets discharged from the recording heads 8 to the one face, so this one face becomes the recording face of the recording medium 5.

The ink jet recording apparatus 1 according to the present embodiment has seven recording heads 8 corresponding to the seven colors of K (black), M (magenta), C (cyan), Y (yellow), G (gray), LM (light magenta), and LC (light cyan). Of course, colors other than these may be used, and there is no need to use all of these colors, either.

Nozzle chips (not shown) on which nozzles are formed are provided to the faces of the recording heads 8 facing the recording medium 5. The nozzle chips may be formed as a single seamless material, or multiple nozzle chips may be arrayed in a row or in a staggered array.

With the present embodiment, the ink jet recording apparatus 1 uses a so-called full-line recording head, where the recording heads 8 have two rows of nozzles arrayed with a size greater than the width of the recording medium 5 in a direction which is parallel with the recording face and intersecting the recording medium conveying direction d (a direction perpendicular to the sheet face). Examples of the ink jet method for discharging ink from the nozzles include a method using thermal devices, a method using piezo devices, a method using electrostatic devices, a method using MEMS devices, and so forth.

The ink jet recording apparatus 1 forms characters and images on the recording medium 5 by discharging ink from the recording heads 8 synchronously with the conveyance of the recording medium 5 by the conveying unit 4. Note that the recording heads 8 are positioned at positions where the positions at which ink is discharged does not overlap with the rotational rollers 6. The method of forming characters and images may be a method where ink is applied to an intermediate transfer member and the later the ink is applied to the recording medium 5, instead of directly discharging ink onto the recording medium 5.

Also, the ink jet recording apparatus 1 has multiple ink tanks 9. Each ink tank 9 independently stores ink of one of the colors. The ink tanks 9 communicate with the recording heads 8 by tubes, so that ink is supplied from the ink tanks 9 to the recording heads 8. An arrangement may be made wherein sub-tanks for adjusting the amount and pressure of ink are provided between the ink tanks 9 and the recording heads 8.

Discharge of ink from the recording heads 8 is performed based on recording data. The timing of ink discharge is determined by output signals from a conveyance encoder 10 provided to the conveying unit 4. The conveyance encoder 10 is provided so as to come in contact with the recording medium 5, and the amount of recording medium 5 being conveyed may be known by the amount of rotation of the conveyance encoder 10.

Further, the ink jet recording apparatus 1 has a scanner unit 11 for reading images on the recording medium 5. After an image is formed on the recording medium 5, the recording medium 5 is conveyed from the conveying unit 4 to the scanner unit 11. At the scanner unit 11, the recorded image in the recording medium 5 is optically read, and confirmation of whether or not there is any problem in the recorded image, confirmation including the state of the ink jet recording apparatus 1 and the ink discharge state of the recording heads 8 and so forth, are performed.

With the present embodiment, the discharge state of the ink is confirmed by reading a test pattern for confirming the state of the recording heads 8, but an arrangement may be made wherein an image other than a test pattern, i.e., an image requested by the user, is used to confirm the quality of printing. In this case, comparison should be made between the image which the user requests and the actually printed image. The confirmation method may be selected from various known methods as suitable.

The ink jet recording apparatus 1 has a cutter unit 12 for cutting the recording medium 5, with the recording medium 5 being guided into the cutter unit 12 having been conveyed in the direction e in the drawing from the scanner unit 11. The recording medium 5 is cut such that the length in the conveying direction of the recording medium 5 is a predetermined length. The predetermined length differs according to the image size being printed. For example, a standard 3R photograph print will have a predetermined length of 127 mm, and an A4 size sheet will have a predetermined length of 297 mm.

There are cases wherein the cutter unit 12 does not cut in image sizes, depending on the contents of a print job regarding which simplex printing or duplex printing, or the like, is determined. In the event that the content of the print job is simplex printing, the cutter unit 12 cuts the recording medium 5 into image sizes at the point that the first face (e.g., front) has been printed. In the event that the content of the print job is duplex printing, the cutter unit 12 does not cut the recording medium 5 at the point that the first face has been printed, but continues to print several image size prints continuously and the cutter unit 12 cuts the recording medium 5 into image sizes at the point that the second face (e.g., rear) has been printed.

Note that the cutter unit 12 is not restricted to cutting into individual image sizes at the time of simple printing or printing of the second face in duplex printing. An arrangement may be made wherein cutting into individual image sizes (pages) is performed manually by a separate cutter device or the like, for example. Also, in the event that cutting of the recording medium 5 in the width direction is necessary, a separate cutter device will be used for the cutting.

The ink jet recording apparatus 1 has a rear face print unit 13 for printing predetermined information on the rear face of the recording medium 5, with the recording medium 5 conveyed from the cutter unit 12 being conveyed to the rear face print unit 13. The rear face print unit 13 is used in the event of performing printing on just one face of the recording medium 5. Information printed on the rear face of the recording medium 5 includes characters, symbols, code, etc., corresponding to each printed image (e.g., order managing No.).

In the event of the recording head 8 printing images for a duplex print job, the recording head 8 prints information such as characters, symbols, code, etc., (e.g., order managing No.). The rear face print unit 13 may employ methods such as stamping of a recording agent, thermal transfer, ink jet, or the like.

The ink jet recording apparatus 1 has a drying unit 14, with recording medium 5 that has passed through the rear face print unit 13 being conveyed to the drying unit 14. The drying unit 14 is a unit for heating the recording medium passing through in the direction g in the drawing with warm air (a warmed gas (air)). Note that instead of using warm air for drying, various other methods may be used as well, such as cold air, heating with a heater, natural drying by just standing by, irradiation of electromagnetic waves such as ultraviolet rays or the like, and so forth.

The recording medium 5 cut into each image size passes through the drying unit 14 one sheet at a time, and is conveyed in the direction h in the drawing into a sorting unit 15. The sorting unit 15 has multiple trays (eighteen in the present embodiment), and the tray for the recording medium 5 to be discharged is distinguished in accordance with the length and so forth of the recording medium 5.

Each tray is assigned a tray No., and the sorting unit 15 discharges the recording medium 5 passing through in the direction i in the drawing according to the tray No. set for each printed image. A sensor is provided above search tray, and the recording medium 5 is discharged into the trays while confirming with the sensor that the trays are empty or full of recording sheets or the like, and so forth.

A tray serving as the discharge destination of the cut recording medium 5 may be a particular tray specified at the originating source of a print job (host apparatus) or maybe an available tray optionally instructed at the ink jet recording apparatus 1 side. In the event of a print job of a number of sheets exceeding the allowable number for each tray, discharge is performed in multiple trays.

The number, sizes, types, etc., of the recording medium 5 which may be discharged to the trays differ depend on the size and shape (type) and so forth of the trays. For example, a large tray 16 which is relatively large is capable of receiving discharge of recording medium 5 larger than A4 size and 3R photograph prints. Also, recording medium 5 of 3R photograph prints may be discharged to a relatively shall size tray 17, but recording medium 5 of A4 size may not be discharged. The large tray 16 holds more sheets of discharged recording medium 5 than the small tray 17.

The state of the recording medium 5 being discharged or discharge being completed and so forth may be indicated to the user in a distinguishable manner, such as using indicators (e.g., LEDs). For example, multiple LEDs each lighting up in different colors may be provided to each of the trays, with the state of each of the trays being notified to the user depending on the color or lit state, blinking state, etc., of the lit LEDs.

Also, the multiple trays may be each given an order of priority, with the ink jet recording apparatus 1 appropriating empty trays (trays with no recording sheets) in order of priority for discharge of recording medium at the time of executing a printing job. The order of priority may be the order in which the user may more easily take out the recording medium 5, but this may be changed by user operations or the like.

Further, the ink jet recording apparatus 1 has a recording medium spooling unit 18 which spools the recording medium 5. The recording medium spooling unit 18 is used for when performing duplex printing. In the event of duplex printing, after image formation is performed on the first face, the recording medium 5 is conveyed in the direction j in the drawing without being cut into each image size at the cutter unit 12, and is spooled as a roll at the recording medium spooling unit 18.

The recording medium 5 spooled by the recording medium spooling unit 18 is guided out in the direction k in the drawing of the ink jet recording apparatus 1 again, so that the second face opposite to the first face is printable, i.e., so that the second face faces the recording head 8. Thus, the recording medium 5 is conveyed so that printing of images is performed on the second face which is the opposite face to the first face.

In the case of simplex printing, the recording medium 5 which has been printed is not spooled at the recording medium spooling unit 18 but rather is conveyed to the sorting unit 15. Thus, with duplex printing, the recording medium 5 is spooled using the recording medium spooling unit 18 and printed on the second face with the recording medium 5 reversed, so the face of the recording medium 5 discharged to the sorting unit 15 differs between the case of simplex printing and duplex printing.

That is to say, in the case of simplex printing, the recording medium 5 is not reversed using the recording medium spooling unit 18. Accordingly, the first face is discharged facing downwards with the ink jet recording apparatus 1 according to the present embodiment with which the conveying direction d at the time of recording and the direction h heading toward the sorting unit 15 are facing the opposite direction. In the event of one printing job involving multiple pages being printed, the pages are discharged in the tray from the first page of the recording medium 5, with subsequent pages being sequentially discharged thereupon, so as to be placed upon the recording sheets already discharged. Such a discharge method is called "face-down discharge".

On the other hand, in the case of duplex printing, the recording medium 5 is reversed using the recording medium spooling unit 18, so the sheets are discharged with the first face facing up. In the event of one printing job involving multiple pages being printed, the pages are discharged in the tray from the first page on which the second face was printed, i.e., the last page of the recording medium 5 at the time of printing the first face, with subsequent pages being sequentially discharged thereupon, so as to be placed upon the recording sheets already discharged, and finally, the first page when printing the first face is discharged. Such a discharge method is called "face-up discharge".

An operating unit 19 is a unit at which the user performs various types of operations, with various types of information being notified to the user. For example, in which tray is stacked the recording medium 5 on which an image was specified by the user, whether the image is being printed or the printing has been completed, and so forth, i.e., the printing state for each order may be confirmed. Also, the user may be operations/confirmation regarding confirmation of various states of the ink jet recording apparatus 1 such as the amount of remaining ink or amount of remaining recording medium 5, instruction for executing maintenance of the apparatus such as head cleaning or the like, and so forth.

Note that while a roll-shaped article has been described as the form of the recording medium 5 on which printing processing is to be performed, the present invention is not restricted to a roll shape, as long as the recording sheet is a long continuous recording medium on which printing may be performed for multiple pages on the same face without cutting partway. Also, cutting of the continuous recording medium may be automatically cut by the image forming apparatus, or the user may manually instruct cutting.

The material of the recording medium 5 is not restricted to paper, and various items may be used, as long as printable. Also, the ink jet recording apparatus 1 is not restricted to printing to continuous recording media, and may be ink jet recording apparatus 1 which is also capable of printing to a cut recording medium cut into predetermined sizes beforehand.

The printing method is not restricted to printing of images with the ink jet method using a liquid ink for printing images. A solid ink may also be used as the recording agent. The printing is not restricted to color printing using multiple color recording agents, and may be monochrome recording with just black (including gray).

Note that the present invention is not restricted to an ink jet recording apparatus using ink as the recording agent, and is widely applicable to various types of image forming apparatuses such as thermal printers (sublimation thermal transfer, etc.), dot impact printers, and so forth.

Printing is not restricted to printing of visible images, and may be printing of invisible or images not readily visible, including, other than general images, various types of printing such as electric wiring patterns, physical patterns in manufacturing of parts, DNA base sequence, and so forth, for example. In other words, embodiments of the present invention are applicable to various types of recording apparatuses, as long as a recording agent is applied to a recording medium 5.

Figure 2:
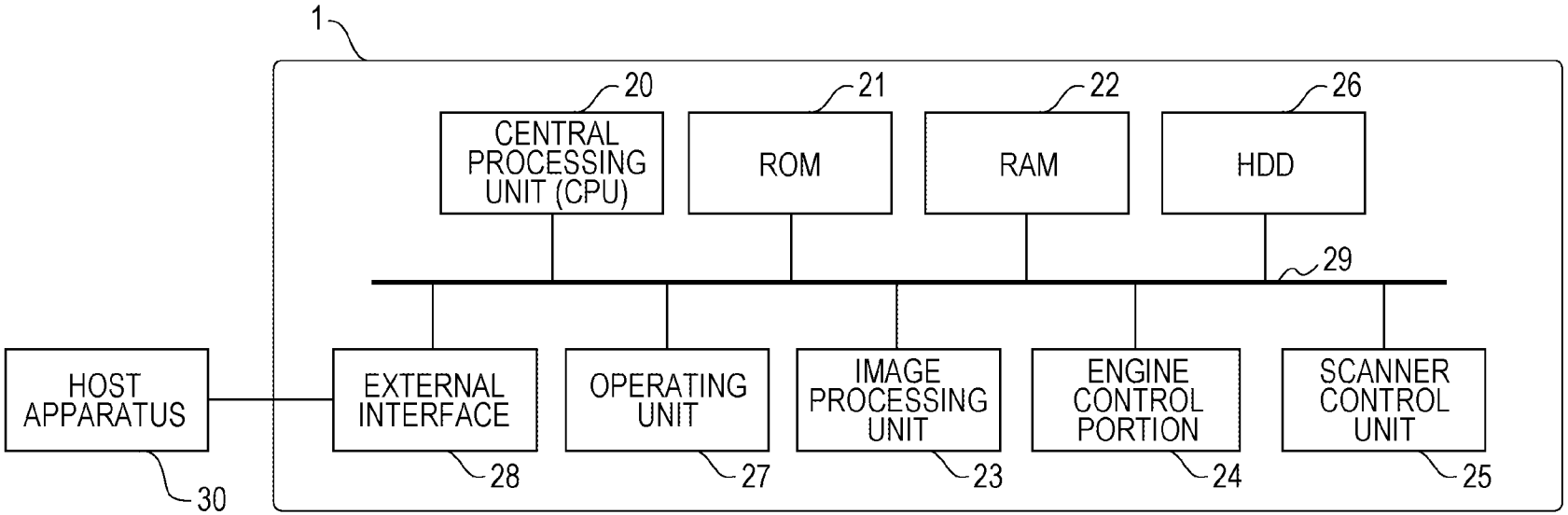
FIG. 2 is a block diagram for describing a configuration relating to control of the ink jet recording apparatus.

FIG. 2 is a block diagram for describing a configuration relating to control of the ink jet recording apparatus 1 according to the present embodiment. Control of the ink jet recording apparatus 1 will be described with reference to FIGS. 1 and 2.

A central processing unit (CPU) 20, ROM 21, RAM 22, image processing unit 23, engine control unit 24, and scanner control unit 25 are primarily included in the control unit 2. An HDD 26, operating unit 27, external interface 28, and so forth, are connected to the control unit 21 via a system bus 29, and are mutually communicable.

The CPU 20 is a central processing unit in the form of a microprocessor (microchip). The CPU 20 controls the operations of the overall ink jet recording apparatus 1 by executing programs and activating hardware. The ROM 21 stores programs for the CPU 20 to execute and fixed data necessary for the operations of the ink jet recording apparatus 1. The RAM 22 is used as a work area for the CPU 20, as a temporary storage region of various types of received data, and as a storage region for various types of setting data.

The HDD 26 has built in a hard disk having a storage region with a capacity greater than the RAM 22. The HDD 26 may store programs for the CPU 20 to execute, printing data, and setting information necessary for the operations of the ink jet recording apparatus 1, in the hard disk, and read this out from the hard disk. Note that a difference large-capacity storage apparatus may be used instead of the HDD 26.

The operating unit 27 includes hard keys and touch panels for the user top perform various types of operations, and a display unit to present (notify) various types of information to the user, and corresponds to the operating unit 19. Also, audio (buzzer, audio, etc.) based on audio information from an audio generating device may be output for presentation of information to the user.

The image processing unit 23 performs rendering (conversion) and image processing of image data (bitmap image) of printing data handled by the ink jet recording apparatus 1 (e.g., data described in a Page Description Language). The color space of the image data included in the input print data (e.g., YCbCr) is converted to a standard RGB color space (e.g., sRGB). Also, the image data is subjected to various types of processing, such as conversion to a valid (printable by the ink jet recording apparatus 1) number of pixels, image analysis, image correction, and so forth. The image data obtained by such image processing is stored in the RAM 22 or the HDD 26.

The engine control portion 24 performs control of the processing of printing images on the recording medium based on printing data, in accordance with control commands received from the CPU 20 and so forth. Specifically, the engine control portion 24 performs ink discharge instructions to the recording heads 8 of each color, discharge timing setting for adjusting the ink landing positions (dot position) on the recording medium 5, and adjustment based on driving state acquisition of the recording head 8, and so forth. The engine control portion 24 causes the recording heads 8 to discharge ink so as to form an image on the recording medium 5. The engine control portion 24 also performs control of the transport rollers, such as instruction of driving of a sheet feed roller, instruction of driving of a conveyance roller, acquisition of a rotational state of a conveyance roller, and so forth, so as to convey the recording medium over a correct path at a correct speed, and to stop the conveyance.

The scanner control portion 25 performs control of the image sensor in accordance with control commands received from the CPU 20 or the like, to read the image on the recording medium 5, acquire analog luminance data for the red (R), green (G), and blue (B) colors, and convert into digital data. A CCD image sensor or CMOS image sensor or the like may be employed for the image sensor. The image sensor may be a linear image sensor or area image sensor.

Also, the scanner control portion 25 analyzes the luminance data acquired from the image sensor, and performs detection of faulty ink discharge, detection of the cut position of recording sheets, and so forth. The recording medium 5 regarding which the scanner control portion 25 has determined that the image has been properly printed is subjected to drying processing of ink on the recording medium 5, and then discharged on a specified tray of the sorting unit 15.

A host apparatus 30 which supplies image data to the ink jet recording apparatus 1 is externally connected to the ink jet recording apparatus 1, with orders for various types of jobs being issued by the host apparatus 30. The host apparatus 30 may be a general-purpose computer (PC), or may be another type of data supplying apparatus. An example of another type of data supplying apparatus includes an image capture apparatus which captures images and generates image data. An image capture apparatus may be a reader (scanner) which reads images on an original and generates image data, a film scanner which reads negative film or positive film and generates image data, or the like.

Other examples of image capture apparatuses include digital cameras which shoot still images and generate digital image data, digital video cameras which shoot moving images and generate moving image data. In addition to this, image data may be generated by installing a photo storage on a network, providing a socket to an image capture device so as to insert detachable portable memory, and reading out image files stored in the photo storage or portable memory. Moreover, various types of data supplying apparatuses may be used instead of the general-purpose PC, such as a terminal dedicated for ink jet recording apparatuses. These data supplying apparatuses may be a component of the ink jet recording apparatus 1, or may be a separate apparatus externally connected to the ink jet recording apparatus 1.

Also, in the event that the host apparatus 30 is a PC, a storage apparatus of the PC has installed therein an operating system (OS), application software for generating image data, and a printer driver for the ink jet recording apparatus 1. The printer driver controls the ink jet recording apparatus 1, converts image data supplied from the application software into a format which the ink jet recording apparatus 1 may handle, and generates printing data. Conversion of printing data to image data may be performed at the host apparatus 30 side and then supplied to the ink jet recording apparatus 1.

Note that not all of the above processing has to be realized by software, and part or all may be realized by hardware. The image data and other commands, and further status signals and the like, supplied from the host apparatus 30, may be exchanged with the ink jet recording apparatus 1 via the external interface 28. The external interface 28 may be a local interface or a network interface. Further, the external interface 28 may be connected by cable or wirelessly.

While the above example involves one CPU 20 control all components within the ink jet recording apparatus 1, other configurations may be used. For example, an arrangement may be made wherein several functional blocks have their own CPUs, so that control is individually made by the respective CPUs. Also, the functional blocks may be in various forms, such as dividing into individual processing units or control portions regardless of the allocation illustrated in the present embodiment, integrating several of these, and so forth. A DMAC (Direct Memory Access Controller) may be used for reading data out from the memory.

Figure 3A:
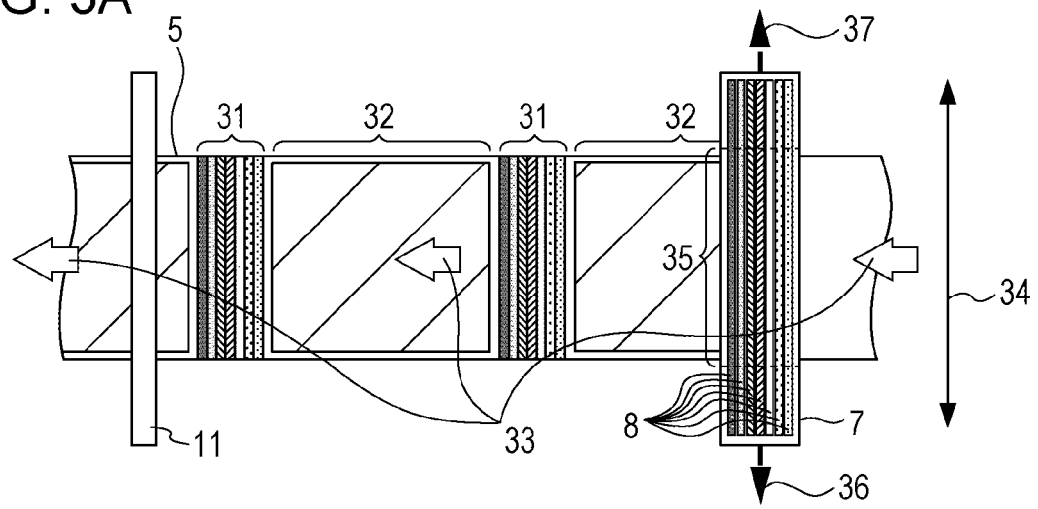
FIGS. 3A through 3C are diagrams of the ink jet recording apparatus, with a portion from a recording head unit to a scanner unit extracted and viewed from a perpendicular direction as to a recording face of a recording medium.
Figure 3B:
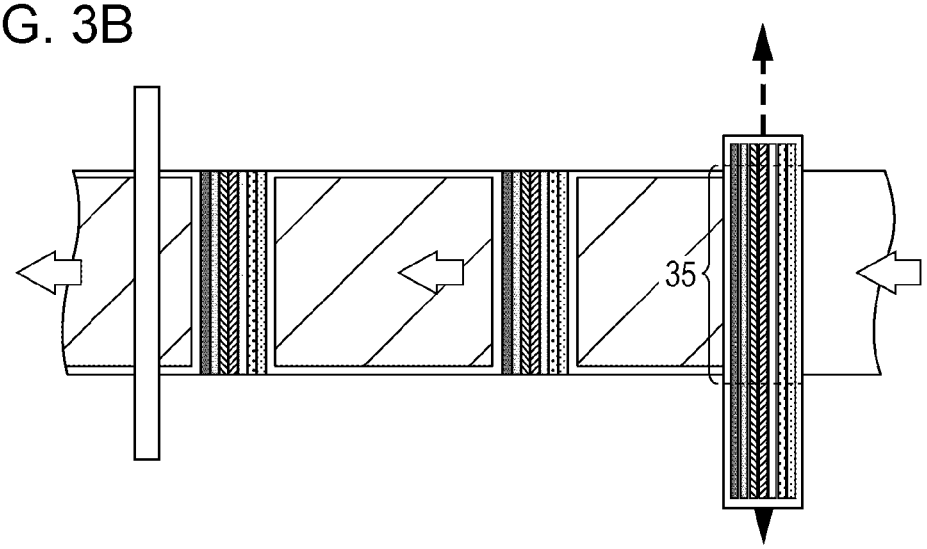
Figure 3C:
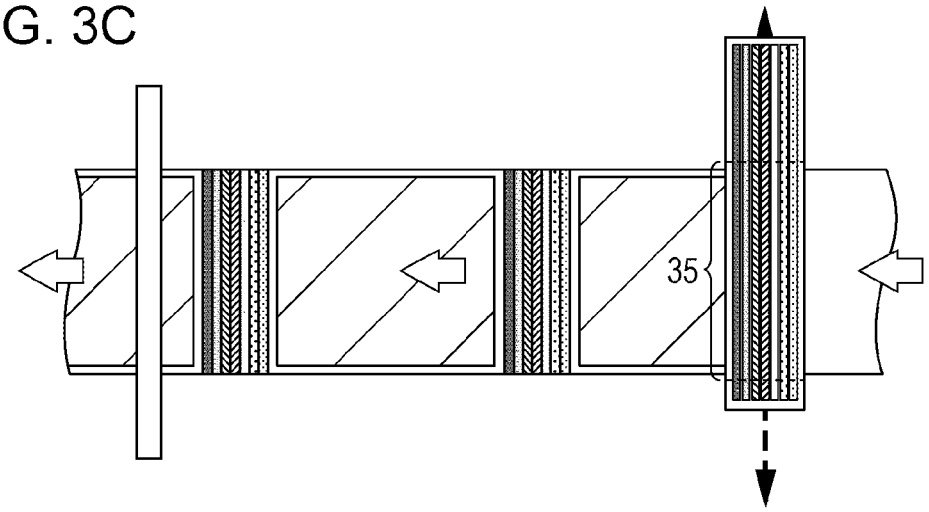

FIGS. 3A through 3C are diagrams of the ink jet recording apparatus 1, with a portion from the recording head unit 7 to the scanner unit 11 extracted and viewed from a perpendicular direction as to the recording face of the recording medium 5. As shown in FIGS. 3A through 3C, a test pattern 31 for monitoring faulty discharge and a practical image 32 for the user to record an instructed image are recorded on the recording medium 5 using the recording head unit 7.

The recording medium 5 is conveyed in a direction from the recording head unit 7 toward the scanner unit 11 (hereinafter referred to as "conveyance direction 33"). The recording head unit 7 is provided so as to be movable in a direction which is parallel to the recording face of the recording medium 5 and which intersects the conveyance direction 33 (hereinafter referred to as "head main scanning direction 34"). The nozzles of the recording head 8 are arrayed in parallel with the head main scanning direction 34.

The recording head unit 7 has a width in the head main scanning direction 34 greater than the recording medium 5. Accordingly, the region where the recording head unit 7 covers the recording medium 5 is the region where ink is discharged from the nozzles (hereinafter referred to as "used nozzle region 35"). The used nozzle region 35 changes by the recording head unit 7 moving in a direction parallel to the head main scanning direction 34. When performing recording, the recording head unit 7 is stopped and recording is performed on the recording medium 5 being conveyed.

That is to say, in the event that the recording head unit 7 moves in a first head main scanning direction 36 which is one direction in the head main scanning direction 34, as shown in FIG. 3B, the used nozzle region 35 moves to the opposite side of the recording head unit 7 as to the first head main scanning direction 36. In the same way, in the event that the recording head unit 7 moves in a second head main scanning direction 37 which is the other direction in the head main scanning direction 34, as shown in FIG. 3C, the used nozzle region 35 moves to the same side of the recording head unit 7 as the first head main scanning direction 36.

By sequentially moving the used nozzle region 35 by moving the recording head unit 7 and performing recording operations, the entire region of the recording head unit 7 may be used, thereby improving the durability of the recording head unit 7. Also, moving the used nozzle region 35 makes the amount of usage of the nozzles more uniform, so the effects of irregularity in the amount of discharged ink may be alleviated, and occurrence of breaks in concentration in the recorded image may be alleviated.

With the present embodiment, the recording heads 8 correspond to the seven colors of K (black), M (magenta), C (cyan), Y (yellow), G (gray), LM (light magenta), and LC (light cyan), from the downstream side of the conveyance direction 33 of the recording medium 5. The scanner unit 11 reads the test pattern 31 recorded on the recording medium 5 to monitor whether or not there is faulty discharge of the recording head unit 7.

Now, a method for detecting faulty discharge will be described. Detection of faulty discharge is performed by the scanner unit 11 reading a test pattern 31 recorded on the recording medium 5, the read image being analyzed, and determination being made regarding whether or not there are faulty discharge nozzles in the recording head 8. In the event that determination is made that there is a faulty discharge nozzle, the control unit 2 (FIG. 1) may stop the recording operations and perform recovery control of the recording head 8, or may perform substitute droplet discharge where normal nozzles perform ink droplet discharge instead of the faulty discharge nozzle. Substitute droplet discharge is also called "faulty discharge compensation".

Description will be made regarding faulty discharge compensation. In the event that there is a faulty discharge nozzle in the recording head 8, ink is not correctly discharged, so a faulty discharge image with white streaks, for example, occurs in the conveyance direction 33 of the recording medium 5, so the image quality of the recorded image is poor. Faulty discharge compensation is a function where substitute droplet discharge is performed by normal nozzles nearby in the nozzle row direction, for the ink which should have been discharged by the faulty discharge nozzle, thereby alleviating the effects of the faulty discharge image.

The recording head 8 is of a configuration having two rows of nozzles with the present embodiment. Accordingly, with faulty discharge compensation, normal nozzles at the same position in the head main scanning direction 34 as the faulty discharge nozzle, in the nozzle row not including the faulty discharge nozzle, may be used for substitute droplet discharge. Note that in a case of having three or more nozzle rows in the recording head 8, or having multiple recording heads 8, the faulty discharge compensation may be performed by substitute droplet discharge by multiple nozzle rows, or by substitute droplet discharge by nozzles of another recording head 8. Also, substitute droplet discharge by nozzles of another color, or substitute droplet discharge by nozzles of multiple colors, may be performed to alleviate the effects of the faulty discharge image.

Description will be made regarding the test pattern recording process in which the test pattern 31 is recorded on the recording medium. FIGS. 4A through 4D are diagrams describing a method for recording the test pattern 31 according to the present embodiment.

Figure 4A:
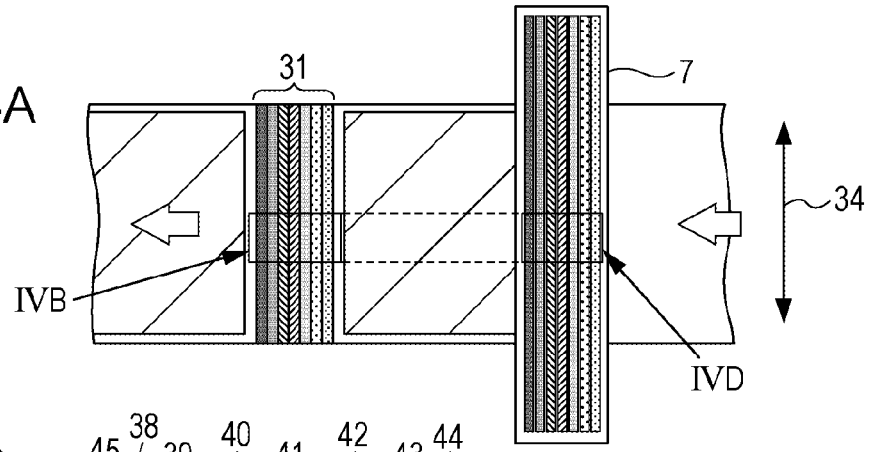
FIGS. 4A through 4D are diagrams for describing a recording method of a test pattern in an embodiment of the present invention.
Figure 4B:
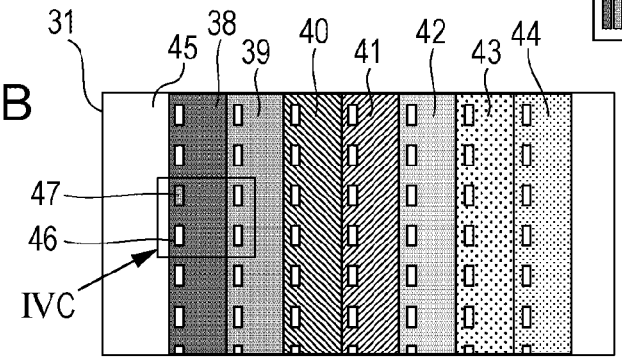

FIG. 4B is an enlargement of a part of the test pattern 31 (the portion IVB shown in FIG. 4A). As shown in FIG. 4B, the test pattern 31 includes test pattern components 38 through 44 for detecting faulty discharge nozzles corresponding to the recording heads 8, and a paper white component 45 where ink droplets are not discharged onto the recording medium 5.

The test pattern components 38 through 44 correspond to the recording heads 8 of K (black), M (magenta), C (cyan), Y (yellow), G (gray), LM (light magenta), and LC (light cyan). The test pattern components 38 through 44 are formed by the recording heads 8 of the corresponding color.

The test pattern components 38 through 44 each have a position mark 46 recorded to detect its own position on the recording medium 5. The position marks 46 are rectangular blank patterns formed in the recording colors corresponding to the respective test pattern components 38 through 44, and are formed at equal intervals in the head main scanning direction 34.

Also, a reference mark 47 for detecting a positional reference between the recording head unit 7 and the recording medium 5 is formed in the test pattern component 38 corresponding to the K (black) recording head 8. The reference mark 47 is a rectangular pattern the same as with the position mark 46, and is a pattern formed by discharging without spacing (hereinafter referred to as "solid recording") by another recording head 8 in a blank region of a position mark 46.

Figure 4C:
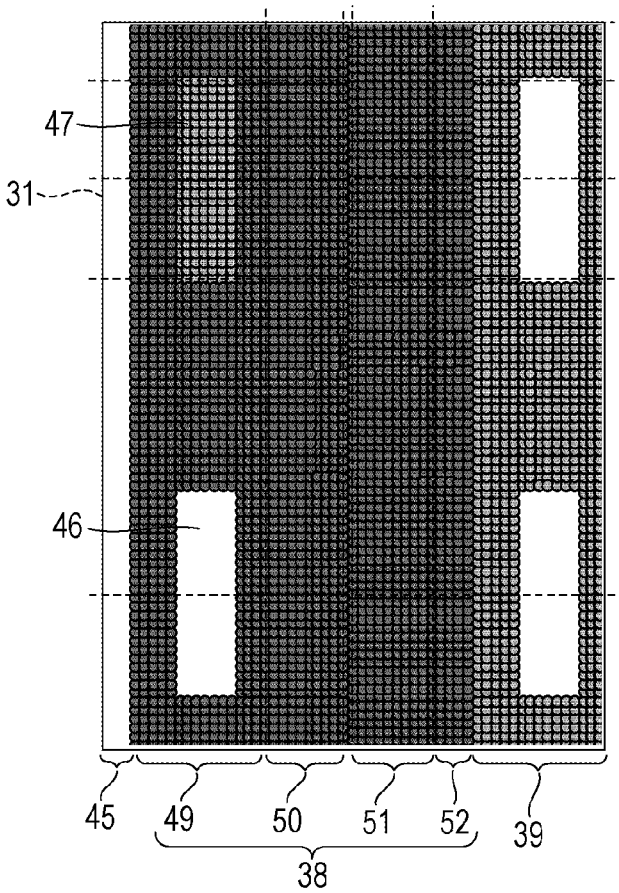
Figure 4D:
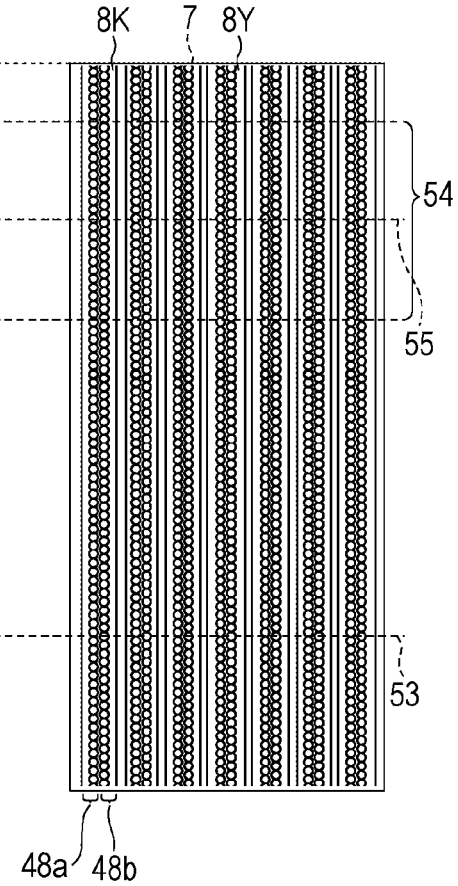

FIG. 4C is a diagram of a portion of the test pattern 31 (the portion IVC in FIG. 4B) enlarged. FIG. 4D is a portion of the recording head unit 7 (the portion IVD shown in FIG. 4A) enlarged. Note that FIGS. 4C and 4D are shown in the same scale. That is to say, in this example, the test pattern 31 shown in FIG. 4C is recorded with the recording head unit 7 shown in FIG. 4D.

In FIG. 4D, the nozzles of the recording head unit 7 are shown as circles. The recording head unit 7 includes a recording head 8K corresponding to K (black), and a recording head 8Y corresponding to Y (yellow). The recording head 8K has a first nozzle row 48*a* and a second nozzle row 48*b*. The other recording heads 8 also have two-row nozzle rows.

How to record the K (black) test pattern component 38 will now be described. The test pattern component 38 includes pattern regions 49 through 52, with each of the pattern regions 49 through 52 being formed by the recording head 8K.

The pattern region 49 includes a position mark 46 and a reference mark 47. The pattern region 49 is formed using both the first nozzle row 48*a* and the second nozzle row 48*b*. By forming the pattern region 49 using both the first nozzle row 48*a* and second nozzle row 48*b*, even in the event that there is a faulty discharge nozzle in one of the rows of nozzles, ink is discharged from the nozzle of the other nozzle row, so a faulty discharge image is not readily formed on the pattern region 49.

The position mark 46 is formed by not discharging ink in a predetermined region within the pattern region 49. We will say that the position of a nozzle corresponding to the center position of the position mark 46 in the head main scanning direction 34 is the reference position 53 of the position mark 46. That is to say, the reference position 53 corresponds to an ink landing position of ink discharged from a particular nozzle. The reference position 53 acts as a scale mark for identifying the nozzle position. Accordingly, multiple reference positions 53 are formed at equal intervals in the array direction of the nozzles. Also, multiple position marks 46 are also formed at equal intervals in the array direction of the nozzles for the same reason. The reference positions 53 are at intervals corresponding to a predetermined number of nozzles. The position marks 46 are marks for identifying the reference positions 53 serving as scale marks, and accordingly are also scale marks.

The reference mark 47 is performed by the K (black) recording head 8K not discharging ink in a predetermined range and the Y (yellow) recording head 8Y discharging ink in the predetermined range. That is to say, the reference mark 47 is formed by the recording head 8Y performing solid recording with nozzles corresponding to the region 54. We will say that the nozzle position corresponding to the center position of the reference mark 47 in the head main scanning direction 34 is a reference point 55 of the reference mark 47.

Note that reference marks 47 may be formed in the test pattern components 39 through 44, and not just the test pattern component 38. That is to say, solid recording may be performed with a second recording color different from the first recording color used for recording the reference mark 47 to form the test pattern component.

A pattern region 50 is a region for detecting faulty discharge nozzles within the first nozzle row 48*a*, and is formed by performing solid recording using the first nozzle row 48*a*. A pattern region 51 is a region for detecting faulty discharge nozzles within the second nozzle row 48*b*, and is formed by performing solid recording using the second nozzle row 48*b*.

A pattern region 52 is a backup region situated behind the test pattern component 38, forming a boundary with the adjacent test pattern component 39. The pattern region 52 is formed using the first nozzle row 48*a* and the second nozzle row 48*b*. Providing the pattern region 52 keeps the test pattern component 39 situated next to the test pattern component 38 from overlapping with the pattern region 51.

Figure 5:
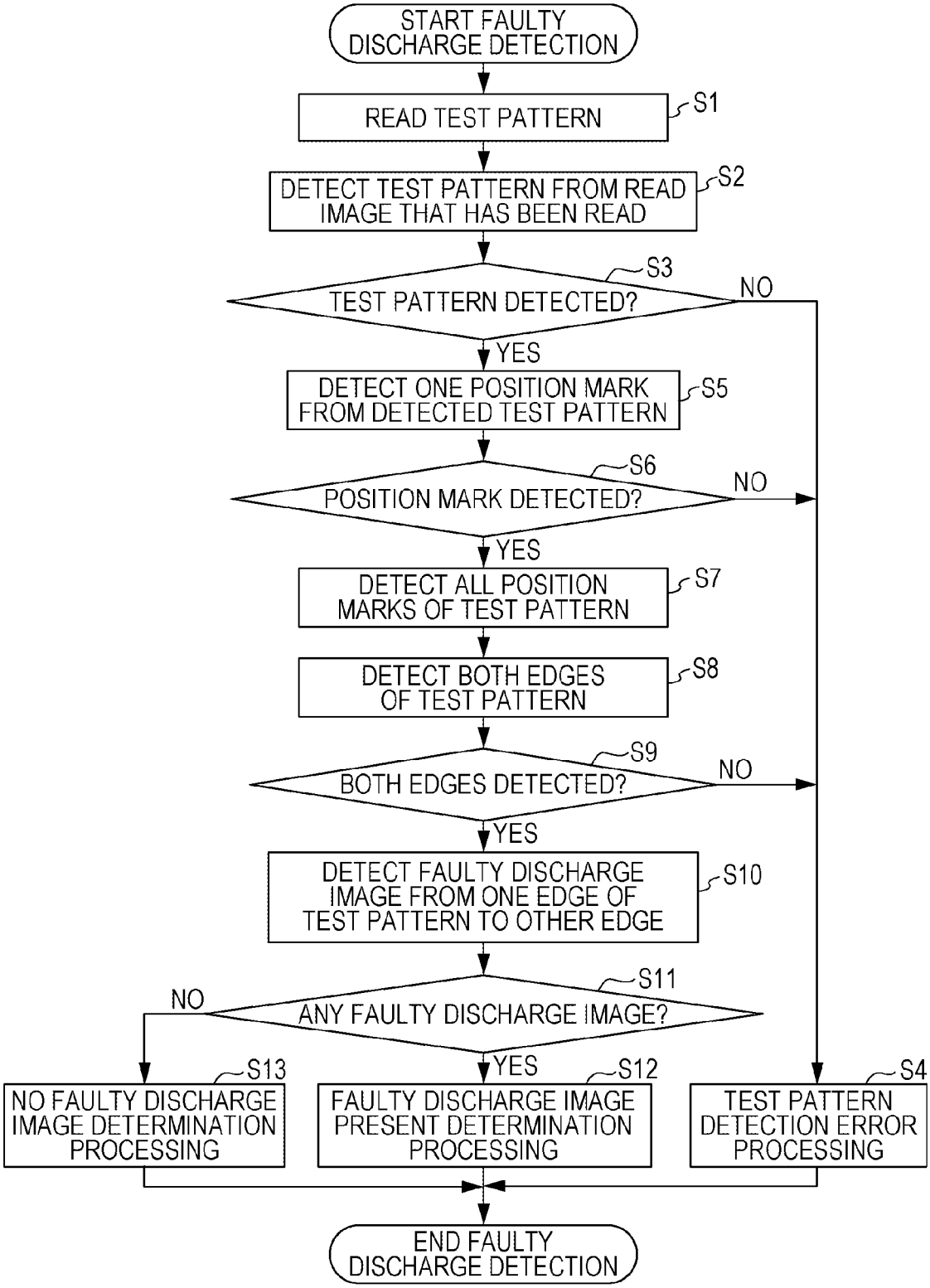
FIG. 5 is a flowchart for describing procedures for detecting whether or not there are faulty discharge nozzles, according to an embodiment of the present invention.

Now, a method for detecting whether or not there is a faulty discharge nozzle in the ink jet recording apparatus 1 according to the present embodiment will be described with reference to FIG. 1 and FIGS. 3A through 5. FIG. 5 is a flowchart for describing the processing of processing for detecting whether or not there is a faulty discharge nozzle.

First, in operation S1 the scanner unit 11 reads the test pattern test pattern 31 recorded by printing on the recording medium 5 (test pattern reading process). The timing for the scanner unit 11 to start reading of the test pattern 31 may be starting reading after a predetermined amount of time elapses after starting printing of the test pattern 31, or to start reading after the recording medium 5 has been conveyed a predetermined amount after ending printing of the test pattern 31. The scanner unit 11 ends reading upon having read a predetermined number of lines after starting reading.

Next, the scanner control portion 25 (FIG. 2) performs processing for detecting the test pattern 31 from the read image that has been read in operation S1 (operation S2).

In operation S3, confirmation is made regarding whether or not the test pattern 31 has been detected from the read image that has been read in operation S1. In the event that the test pattern 31 is not detected, test pattern detection error processing is performed (operation S4). In the event that the test pattern 31 is detected, the processing of operation S5 is performed.

In operation S5, based on the test pattern 31 detected in operation S2, one position mark 46 is detected from the test pattern 31 in the read image.

In operation S6, confirmation is made regarding whether or not one position mark 46 has been detected in the processing in operation S5. In the event that no position mark 46 is detected, test pattern detection error processing is performed (operation S4). In the event that the one position mark 46 has been detected, the processing of operation S7 is performed.

In operation S7, based on the one position mark 46 detected in the processing in operation S5, all position marks 46 in the test pattern 31 are detected.

In operation S8, both edge portions of the test pattern 31 in the head main scanning direction 34 are detected based on all position marks 46 detected in operation S7.

In operation S9, confirmation is made regarding whether or not both edge portions of the test pattern 31 have been detected in operation S8, and if not detected, test pattern detection error processing is performed (operation S4). In the event that both edge portions have been detected, the processing of operation S10 is performed.

In operation S10, whether or not there is a faulty discharge image within the test pattern 31, i.e., whether or not there is a faulty discharge nozzle (faulty discharge determination processing) is performed based on the position of both edge portions of the test pattern 31 found in operation S8. Detection of whether or not there is a faulty discharge image is performed for each test pattern component 38 through 44 of each recording head 8.

In operation S11, confirmation is made regarding whether or not a faulty discharge image has been detected. In the event that a faulty discharge image has been detected, the processing of operation S12 is performed, and in the event that a faulty discharge image has not been detected, the processing of operation S13 is performed.

In operation S12, processing is performed for a case that determination has been made that there has been found a faulty discharge image as a result of the analysis of the test pattern 31. Here, notification is made to a printing control potion (not shown) that there is a faulty discharge image, and the recording operation may be stopped to perform recovery operations of the recording head unit 7, or later-described faulty discharge compensation processing.

In operation S13, processing is performed for a case that determination has been made that there has been found no faulty discharge image as a result of the analysis of the test pattern 31. Here, notification is made to the printing control portion that there is no faulty discharge image, and the recording operation continues.

In operation S4, processing is performed in the case that the test pattern 31 was not detected from the read image that has been read as a result of analysis of the test pattern 31, or in the event of failing to detect a position mark 46. Here, notification is made to the a printing control potion that there is an abnormality in the recording of the test pattern 31, and the recording operation is stopped.

The processing for detecting the test pattern 31 in operation S2, and the processing for detecting one position mark 46 from the test pattern 31 in operation S5 will be described. FIGS. 6A through 6D are diagrams for describing processing for detecting the test pattern 31 from the read image that has been read by the scanner unit 11 (FIGS. 1 and 3A through 3C), and processing for detecting one position mark 46 from the detected test pattern 31.

Figure 6A:
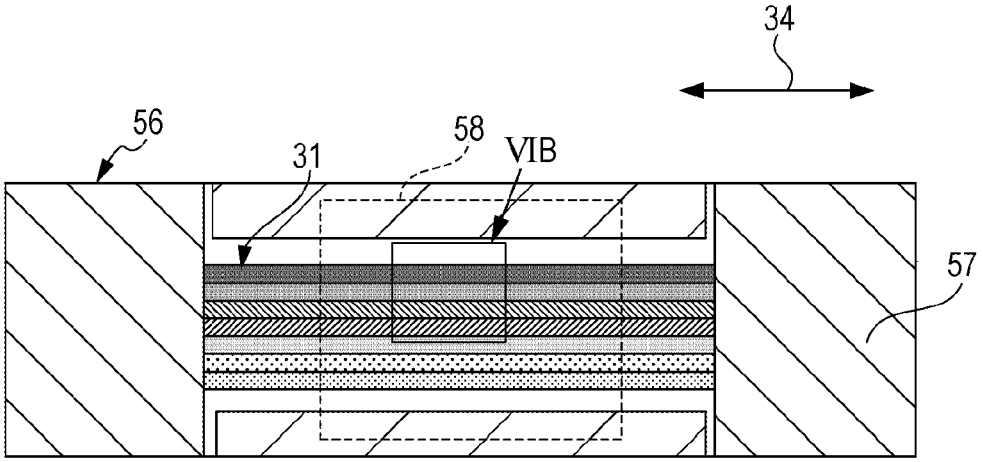
FIGS. 6A through 6D are diagrams for describing processing for detecting a test pattern from a read image that has been read from a scanner unit (FIGS. 1 and 3A through 3C), and processing for detecting one position mark from the detected test pattern.

FIG. 6A is a diagram illustrating a read image of the test pattern 31 recorded by printing on the recording medium 5, read by the scanner unit 11 (FIGS. 3A through 3C). The read image 56 is a color image, each of the RGB channels having 16 bits.

As shown in FIG. 6A, the read image 56 includes an outside-of-the-recording-medium region 57, obtained by reading on the outside of the recording medium 5 (FIGS. 3A through 3C) in the head main scanning direction 34 direction. The outside-of-the-recording-medium region 57 is a result of having read the members of the ink jet recording apparatus 1 that face the reading unit of the scanner unit 11 (FIGS. 3A through 3C). With the present embodiment, the member facing the reading portion of the scanner unit 11 is a calibration roller used for calibration of the scanner.

The calibration roller is a roller for the scanner unit 11 to obtain a white reference, and a portion of the calibration roller is provided as a white reference region. With the present embodiment, the portions other than the white reference region are formed with a black resin member, so the luminance of the resin member being read by the scanner unit 11 will be relatively low. Accordingly, the outside-of-the-recording-medium region 57 obtained as the result of the black resin member being read will be relatively low. Note that the roller member other than the white reference region of the calibration roller may be formed of other than black resin, or the entire face of the calibration roller may be formed as the white reference region.

Figure 6B:
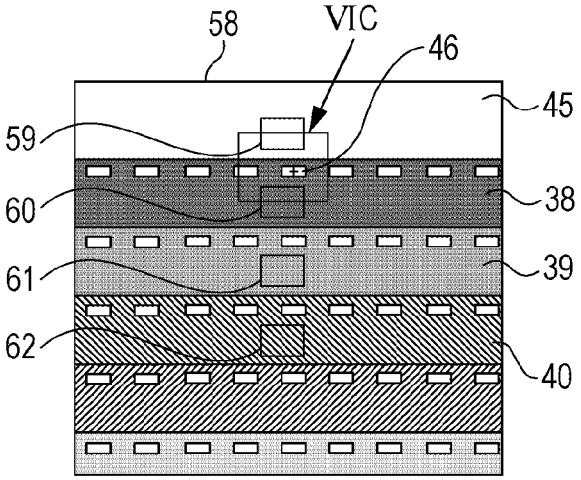

The processing for detecting the test pattern 31 will be described. The read image 56 includes a test pattern detection region 58 for detecting the test pattern 31. FIG. 6B is a diagram of a portion of the test pattern detection region 58 (the portion VIB shown in FIG. 6A) enlarged.

Determination of detection of the test pattern 31 is performed by threshold value determination of an average concentration in a predetermined region. The test pattern detection region 58 has determination regions 59 through 62 for detecting the regions of paper white, K (black), M (magenta), and C (cyan). The sizes of the detection regions 59 through 62 are smaller than the sizes of the paper white component 45 and test pattern components 38 through 40. The distances between the determination regions 59 through 62 correspond to the width of the paper white component 45 and test pattern components 38 through 40.

The determination region 59 is a region for performing determination of the paper white component 45. The method for determination of the paper white component 45 is to determine that the average luminance of each of the R, G, and B channels within the determination region 59 is greater than a predetermined threshold value.

The determination region 60 is a region for performing determination of the K (black) test pattern component 38. The method for determination of the K (black) test pattern component 38 is to determine that the average luminance of each of the R, G, and B channels within the determination region 60 is a predetermined threshold value or lower.

The determination region 61 is a region for performing determination of the M (magenta) test pattern component 39. The method for determination of the M (magenta) test pattern component 39 is to determine that the average luminance of each of the R and B channels within the determination region 61 is greater than the predetermined threshold value, and the average luminance of the G channel is the predetermined threshold value or lower.

The determination region 62 is a region for performing determination of the C (Cyan) test pattern component 40. The method for determination of the C (Cyan) test pattern component 40 is to determine that the average luminance of the R channel within the determination region 62 is the predetermined threshold value or lower, and the average luminance of each of the G and B channels is greater than the predetermined threshold value.

In the event that determination is made that the determination regions 59 through 62 are regions corresponding to the test pattern 31, determination is made that the test pattern 31 has been detected. In the event that determination is made that one or more of the determination regions 59 through 62 are not regions corresponding to the test pattern 31, determination is made that the test pattern 31 has not been detected.

Next, processing for detecting on position mark 46 from the test pattern 31 will be described. Detection of the position mark 46 is performed by performing image mutual correlation processing of comparing an image of the position mark 46 held beforehand with the image detected with the scanner unit 11.

With the present embodiment, a method is employed wherein SSD (Sum of Squared intensity Difference) is calculated as the image mutual correlation processing, and the degree of difference between the searched region and a template image is detected. Note that other calculation methods, such as SAD (Sum of Absolute Difference) and NCC (Normalized Cross-Correlation) may be used as the image mutual correlation processing.

Image mutual correlation processing is performed using any one channel of the RGB of the read image. The channel to be processed should be the channel of which the luminance is the lowest. For example, in the case of performing image mutual correlation processing of the C (cyan) test pattern component 40, the luminance of the R channel in the read image is the lowest, so the R channel should be processed.

Figure 6C:
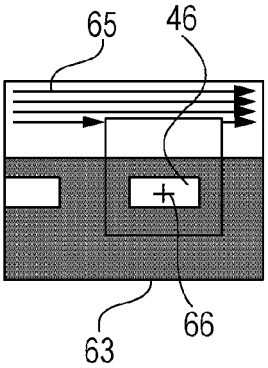

FIG. 6C is a diagram illustrating a portion of the boundary between the paper white component 45 and the test pattern component 38 (the portion VIC shown in FIG. 6B) enlarged.

The range shown in FIG. 6C is an SSD search region image 63 for detecting the position mark 46. The SSD search region image 63 is a region including at least one position mark 46. By setting the SSD search region image 63 so as to straddle the detection region 59 and the detection region 60, the SSD search region image 63 may be made to include at least one position mark 46.

Figure 6D:
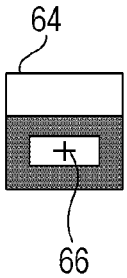

FIG. 6D is a diagram of a position mark 46 saved in the control unit 2 (FIG. 1) beforehand. The diagram shown in FIG. 6D is a template image 64 used for image mutual correlation processing.

In the image mutual correlation processing between the SSD search region image 63 and the template image 64, the template image 64 shown in FIG. 6D is scanned over the SSD search region image 63 shown in FIG. 6C. With the present embodiment, the template image 64 is scanned following an arrow 65.

The SSD is calculated while scanning the template image 64, and the position where the degree of difference of the SSD between the portion of the SSD search region image 63 and the template image 64 is smallest is obtained. Further, in the event that the degree of difference at that position is a predetermined value or lower, determination is made that this position is a position where there is a position mark 46, and the center of the position mark 46 is recognized as a position mark center 66. In the event that the degree of difference at the position where the degree of difference is smallest is greater than the predetermined value, determination is made that this position is not a position where a position mark 46 is.

Next, the processing for detecting all position marks 46 included in the test pattern 31, and processing for detecting both edges of the test pattern 31, in operations S7 and S8 (FIG. 5), will be described with reference to FIGS. 7A through 8F.

Figure 7A:
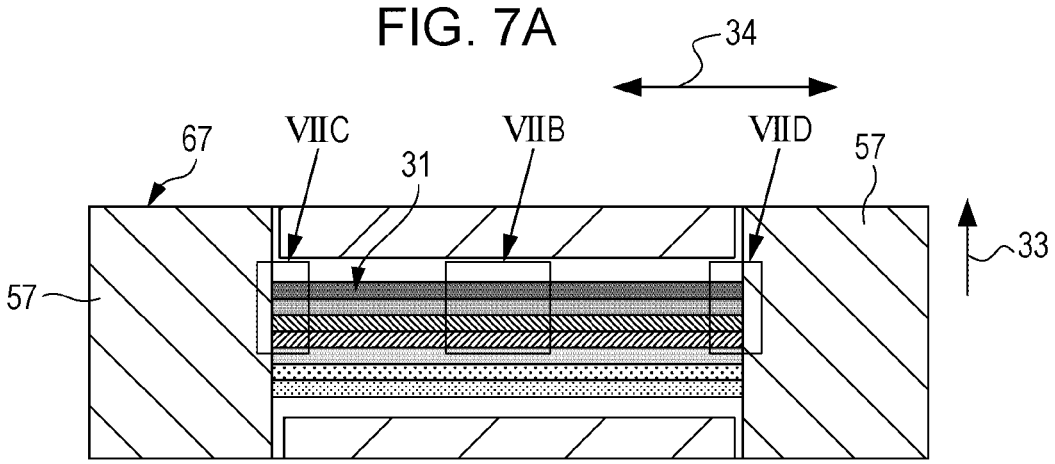
FIGS. 7A through 7F are diagrams for describing processing for detecting all position marks of a test pattern in borderless printing, and processing for detecting both edges of a test pattern.

FIGS. 7A through 7F are diagrams for describing processing for detecting all position marks 46 in the test pattern 31 when performing borderless recording, and processing for detecting both edge portions of the test pattern 31. FIG. 7A is a diagram illustrating a read image obtained by the scanner unit 11 (FIGS. 3A through 3C) reading the test pattern 31 recorded by printing on the recording medium 5 (FIGS. 3A through 3C). The read image 67 is a color image, each of the RGB channels having 16 bits.

Figure 7C:
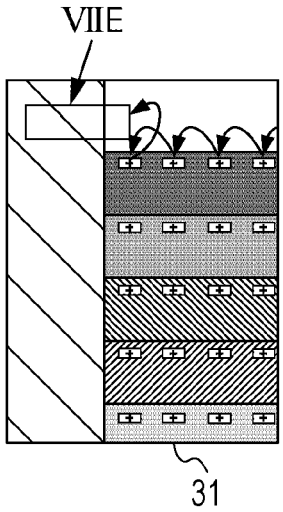
Figure 7B:
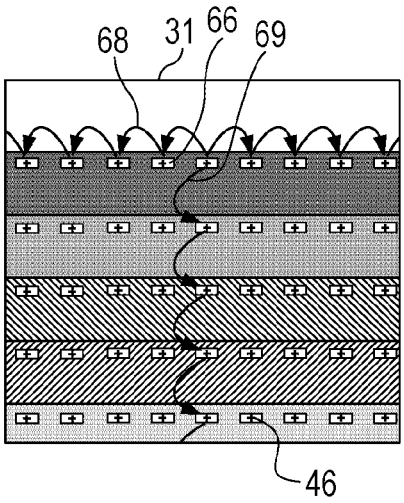
Figure 7D:
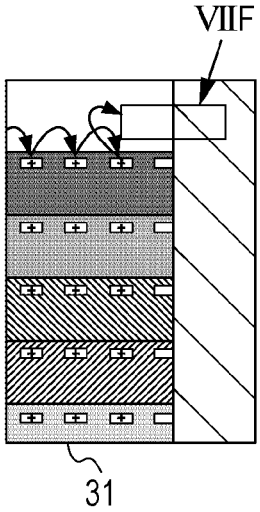

FIG. 7B is a diagram showing around the center of the test pattern 31 in the head main scanning direction 34, enlarged. FIG. 7C is a diagram showing around the one edge of the test pattern 31 in the head main scanning direction 34, enlarged, and FIG. 7D is a diagram showing around the other edge of the test pattern 31 in the head main scanning direction 34, enlarged.

As shown in FIG. 7B, a position mark center 66 of one position mark 46 is recognized. A search region image for detecting other position marks 46 from the position mark center 66 is identified. The position marks 46 are detected from the search region image by image mutual correlation processing using a template image of the position mark 46 saved beforehand. Details of the image mutual correlation processing are the same as the processing described with reference to FIGS. 6A through 6D.

Detection of the position marks 46 is repeatedly performed in the direction from the position mark center 66 toward one edge of the test pattern 31 (the direction of the arrow 68 shown in FIG. 7B). In the event that determination is made as the result of SSD that the degree of difference is greater than the predetermined value and that this is not a position mark, detection of position marks 46 in the direction of the arrow 68 is ended.

Next, detection of the position marks 46 is repeatedly performed in the direction from the position mark center 66 toward the other edge of the test pattern 31 (the direction of the arrow 69 shown in FIG. 7B). In the event that determination is made as the result of SSD that the degree of difference is greater than the predetermined value and that this is not a position mark, detection of position marks 46 in the direction of the arrow 69 is ended. Next, detection of a test pattern detection mark below is performed from the position mark center 66, and detection of position marks is repeated in the direction toward both edges of the test pattern 31 in the same way.

Next, detection of the edges of the test pattern 31 in the head main scanning direction 34 will be described. The test pattern 31 shown in FIGS. 7A through 7F has been formed with a test pattern 31 recorded on the recording medium 5 by borderless recording. Accordingly, the edge of the recording medium 5 is the edge of the test pattern 31.

Figure 7E:
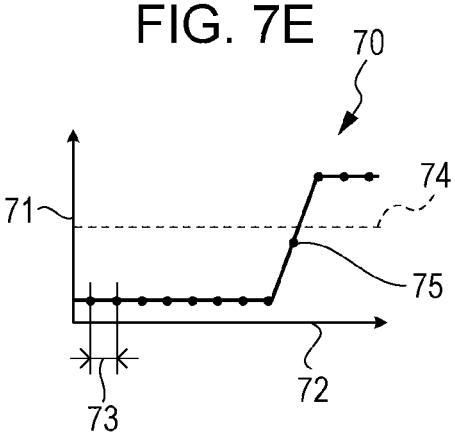

Detection of one edge of the test pattern 31 will be described. FIG. 7E is a graph (hereinafter called graph 70) illustrating the average luminance value obtained by adding and averaging the luminance values of the test pattern 31 at one edge in the conveyance direction 33 of the recording medium 5. In the graph 70, Y axis 71 represents the average luminance value, and X axis 72 represents the average pixel position.

An average pixel interval 73 corresponds to the interval of one pixel read in by the scanner. The dotted line in the graph 70 represents the luminance threshold 74 for detecting the edge of the test pattern 31. The edge of the test pattern 31 is detected when the average luminance value as to the average pixel positions reaches the luminance threshold 74. In the graph 70, a pattern edge pixel position 75 is detected as one edge of the test pattern 31.

Figure 7F:
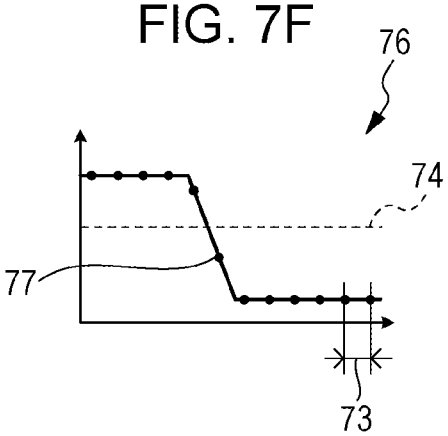

Detection of the other edge of the test pattern 31 is also detected by performing processing the same as the processing for detecting the one edge of the test pattern 31. FIG. 7F is a graph (graph 76) illustrating the average luminance value obtained by adding and averaging the luminance values of the test pattern 31 at the other edge in the conveyance direction 33 of the recording medium 5. In the graph 76, a pattern edge pixel position 77 is detected as the other edge of the test pattern 31.

Figure 8A:
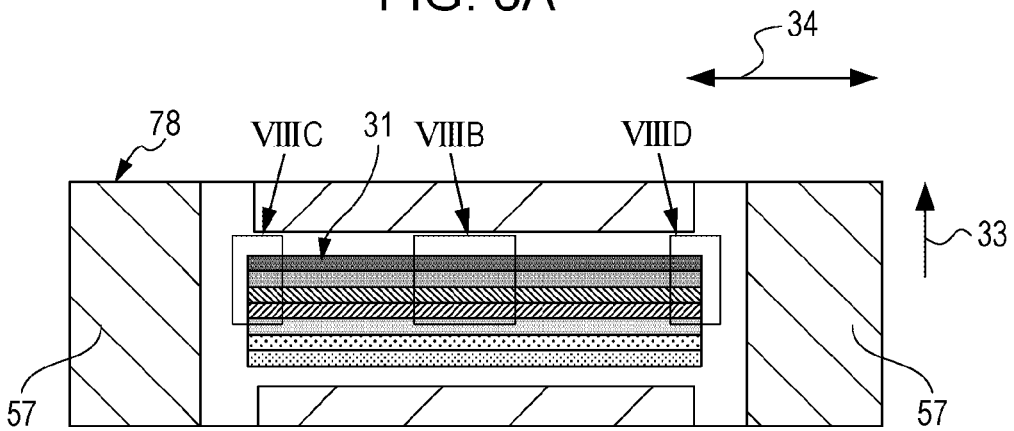
FIGS. 8A through 8F are diagrams for describing processing for detecting both edges of a test pattern in borderless printing.

FIGS. 8A through 8F are diagrams for describing processing for detecting both edges of the test pattern 31 in with-border recording. Here, description will be made regarding the processing of recording the test pattern 31 with borders, in the event that the width of the recording medium 5 (FIGS. 3A through 3C) is greater than the width of the print recording range. FIG. 8A is a diagram illustrating a read image obtained by the scanner unit 11 (FIGS. 3A through 3C) reading the test pattern 31 recorded by printing on the recording medium 5 (FIGS. 3A through 3C). The read image 78 is a color image, each of the RGB channels having 16 bits.

Figure 8C:
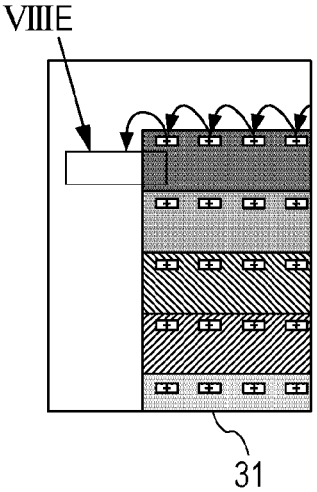
Figure 8B:
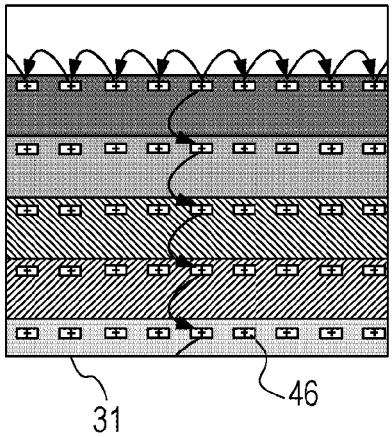
Figure 8D:
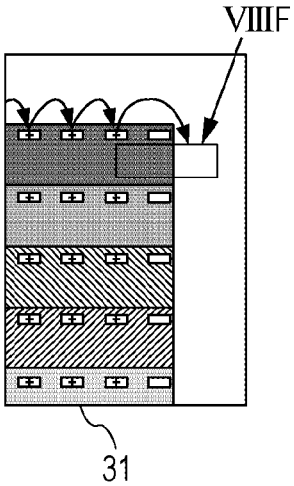

FIG. 8B is a diagram showing around the center of the test pattern 31 in the head main scanning direction 34, enlarged. FIG. 8C is a diagram showing around the one edge of the test pattern 31 in the head main scanning direction 34, enlarged, and FIG. 8D is a diagram showing around the other edge of the test pattern 31 in the head main scanning direction 34, enlarged.

The position marks 46 in the test pattern 31 in with-border recording may be detected in the way as with the detection method of the position marks 46 in the test pattern 31 with borderless recording. In the processing for detecting both edges of the test pattern 31 in with-border recording, the test pattern 31 is recorded on the recording medium 5 (FIGS. 3A through 3C) with a border, so all that needs to be done for detection of the edge of the test pattern 31 is to detect the boundary between the test pattern 31 and the paper white.

Figure 8E:
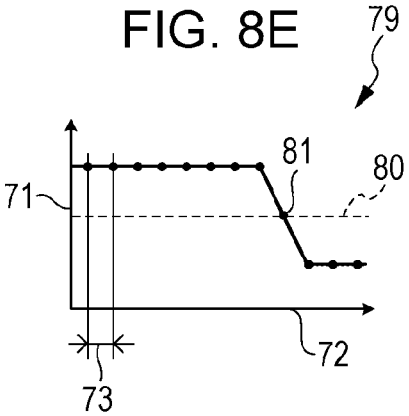

Detection of one edge of the test pattern 31 will be described. FIG. 8E is a graph (hereinafter called graph 79) illustrating the average luminance value obtained by adding and averaging the luminance values of the test pattern 31 at one edge in the conveyance direction 33 of the recording medium 5. In the graph 79, Y axis 71 represents the average luminance value, and X axis 72 represents the average pixel position. The edge of the test pattern 31 is detected when the average luminance value as to the average pixel positions reaches a luminance threshold 80 in the graph 79. In the graph 79, a pattern edge pixel position 81 is detected as one edge of the test pattern 31.

Figure 8F:
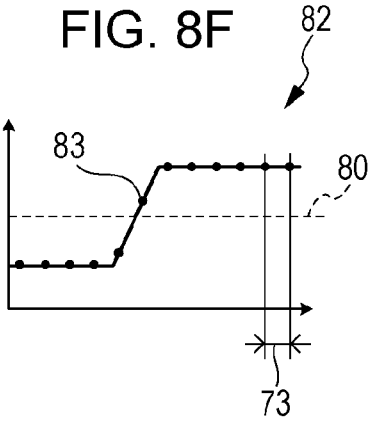

Detection of the other edge of the test pattern 31 is also detected by performing processing the same as the processing for detecting the one edge of the test pattern 31. FIG. 8F is a graph (hereinafter called graph 82) illustrating the average luminance value obtained by adding and averaging the luminance values of the test pattern 31 at the other edge in the conveyance direction 33 of the recording medium 5. In the graph 82, a pattern edge pixel position 83 is detected as the other edge of the test pattern 31.

Figure 9A:
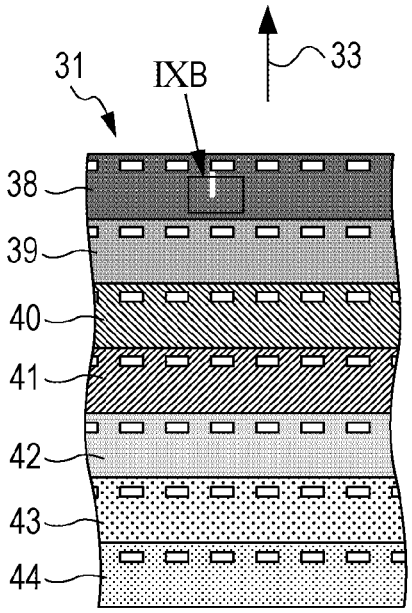
FIGS. 9A through 9D are diagrams for describing processing for detecting whether or not there is a faulty discharge image within a test pattern.
Figure 9C:
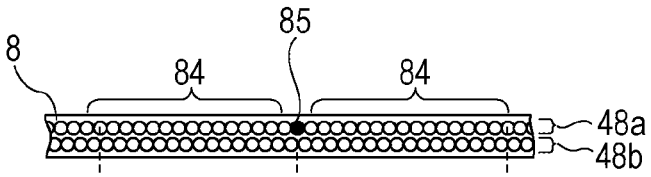
Figure 9B:
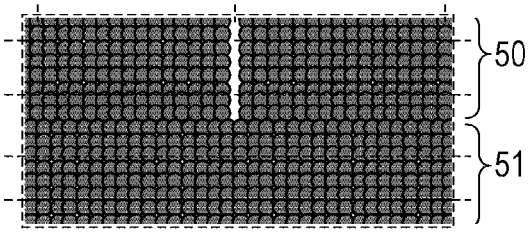

Processing for detecting whether or not there is a faulty discharge image within the test pattern in operation S10 (FIG. 5) will be described. FIGS. 9A through 9D are diagrams for describing the processing for detecting whether or not there is a faulty discharge image within the test pattern 31. FIG. 9A is a diagram illustrating formation of a test pattern 31 in a state of having a faulty discharge nozzle, and FIG. 9B is an enlarged drawing illustrating around the region where the white-streak faulty discharge image has been formed by the faulty discharge nozzle. FIG. 9C is an enlarged drawing of the recording head 8 including a faulty discharge nozzle. Note that FIG. 9B and FIG. 9C enlarged by the same scale, and illustrate the position of the nozzle and the landing position (dot position) in the test pattern 31 in the a corresponding manner.

The recording head 8 shown in FIG. 9C includes normal nozzles 84 capable of correctly discharging ink, and a faulty discharge nozzle 85 in a faulty discharge state. The faulty discharge nozzle 85 is included in the first nozzle row 48*a*, and a faulty discharge image including a white streak is formed in the pattern region 50. NO faulty discharge nozzle is included in the second nozzle row 48*b*, so no faulty discharge image occurs in the pattern region 51.

By detecting a faulty discharge image, the faulty discharge nozzle 85 may be detected. Detection of the faulty discharge image is performed by detecting the luminance values in the read image. With the present embodiment, a case will be described regarding a case where the reading resolution is lower than the nozzle array resolution of the recording head 8. In this case, an image region including dots formed by the faulty discharge nozzle 85 is identified, rather than detection being performed in increments of dots. Note that the reading resolution of the scanner may be higher than the resolution of the nozzle array, and in the case of this configuration the faulty discharge image may be identified in increments of dots, and the faulty discharge nozzle may be detected in increments of nozzles.

Detection of the faulty discharge image is performed using the information of one channel of the RGB channels of the read image. The channel to be analyzed should be the channel regarding which the luminance in the read image is the lowest for the test pattern components 38 through 44. For example, in the case of performing image mutual correlation processing of the C (cyan) test pattern component 40, the luminance of the R channel in the read image is the lowest, so the R channel should be processed.

Figure 9D:
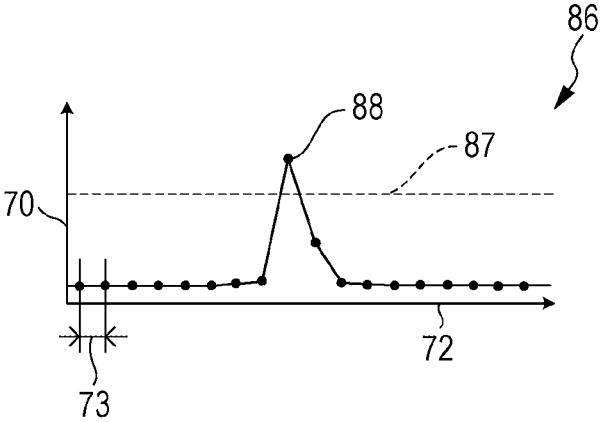

FIG. 9D is a graph (hereinafter called graph 86) illustrating the average luminance value obtained by adding and averaging the luminance values of the pattern region 50 in the read image in the conveyance direction 33 of the recording medium 5. In the graph 86, Y axis 71 represents the average luminance value, and X axis 72 represents the average pixel position. An average pixel interval 73 corresponds to the interval of one pixel read in by the scanner.

A luminance threshold 87 is for detecting faulty discharge images based on the average luminance value. In the graph 86, a pixel 88 is detected as a faulty discharge image. In the detection of whether or not there is faulty discharge image, a region including multiple nozzles corresponding to the faulty discharge image is detected as a region including faulty discharge nozzles.

In the event that the luminance at the time of reading the image suddenly changes, flaring may occur such that the scanner is not capable of reading the image as it is. With the present embodiment, the position marks 46 are formed as blank rectangles, thereby forming a backup region in which ink has been discharged between the position mark 46 and pattern region 50 (FIGS. 4A through 4D). Forming the backup region keeps the position mark 46 from interfering with detection of faulty discharge images. The reference mark 47 is also formed as a rectangle and a backup region is formed between the reference mark 47 and the pattern region 50, so that the reference mark 47 does not interfere with detection of faulty discharge images.

Figure 10:
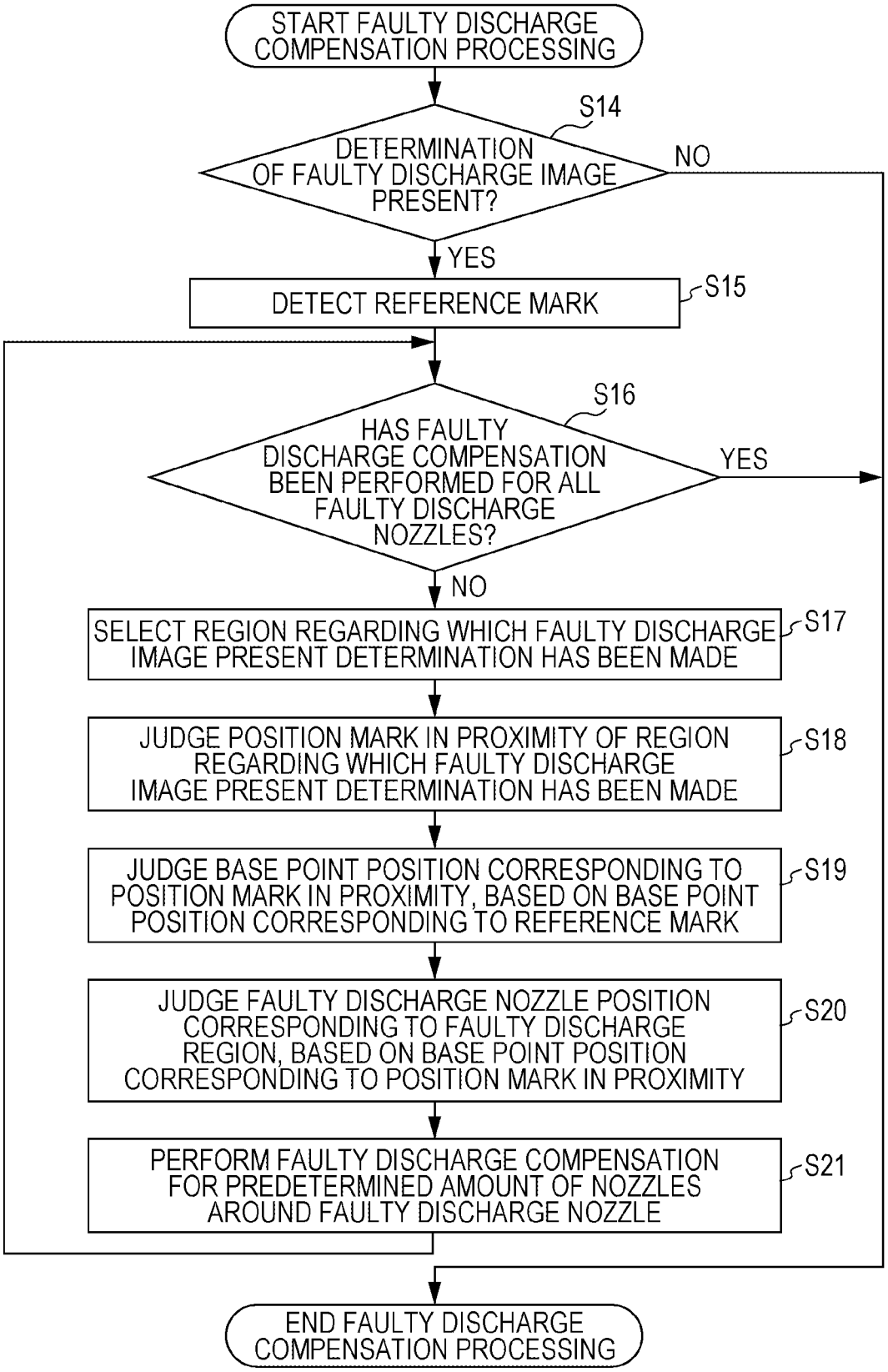
FIG. 10 is a flowchart for describing procedures for faulty discharge compensation with an embodiment of the present invention.

Next, description will be made regarding faulty discharge complementing processing, which is an example of processing in the case that there has been determination that there is a faulty discharge image (operation S12 shown in FIG. 5), with reference to FIGS. 3A through 4D and FIG. 10. FIG. 10 is a flowchart for describing the procedures for faulty discharge complementing processing according to the present embodiment.

In operation S14, the scanner control portion 25 (FIG. 2) confirms whether the faulty discharge determination process results were a faulty discharge image present determination or a no faulty discharge image determination. In the event that there is a faulty discharge image, the processing of operation S15 is performed. Otherwise, the faulty discharge complementing processing ends.

In operation S15, the reference mark 47 is detected from the test pattern 31.

In operation S16, determination is made regarding whether or not faulty discharge complementing processing has been performed for all faulty discharge nozzles. In the event that faulty discharge complementing processing has been performed for all faulty discharge nozzles, the faulty discharge complementing processing ends. In the event that faulty discharge complementing processing has not been performed for all faulty discharge nozzles, the processing of operation S17 is performed.

In operation S17, a faulty discharge nozzle regarding which faulty discharge complementing processing has not been performed is selected.

In operation S18, a position mark 46 in close proximity to the selected faulty discharge nozzle is selected.

In operation S19, the reference position 53 corresponding to the position mark 46 detected in operation S18 is determined from the position of the reference mark 47.

In operation S20, the position of the faulty discharge nozzle is calculated based on the reference position 53 determined in operation S19 (faulty discharge nozzle position calculating process).

In operation S21, faulty discharge complementing is performed for nozzles in a predetermined range including the faulty discharge nozzle.

The processing for detecting the reference mark 47 in operation S15, and the faulty discharge complementing processing from operations S18 through S21 where the faulty discharge nozzle position is calculated and faulty discharge complementing processing is performed, will be described with reference to FIGS. 11 through 13B.

Figure 11:
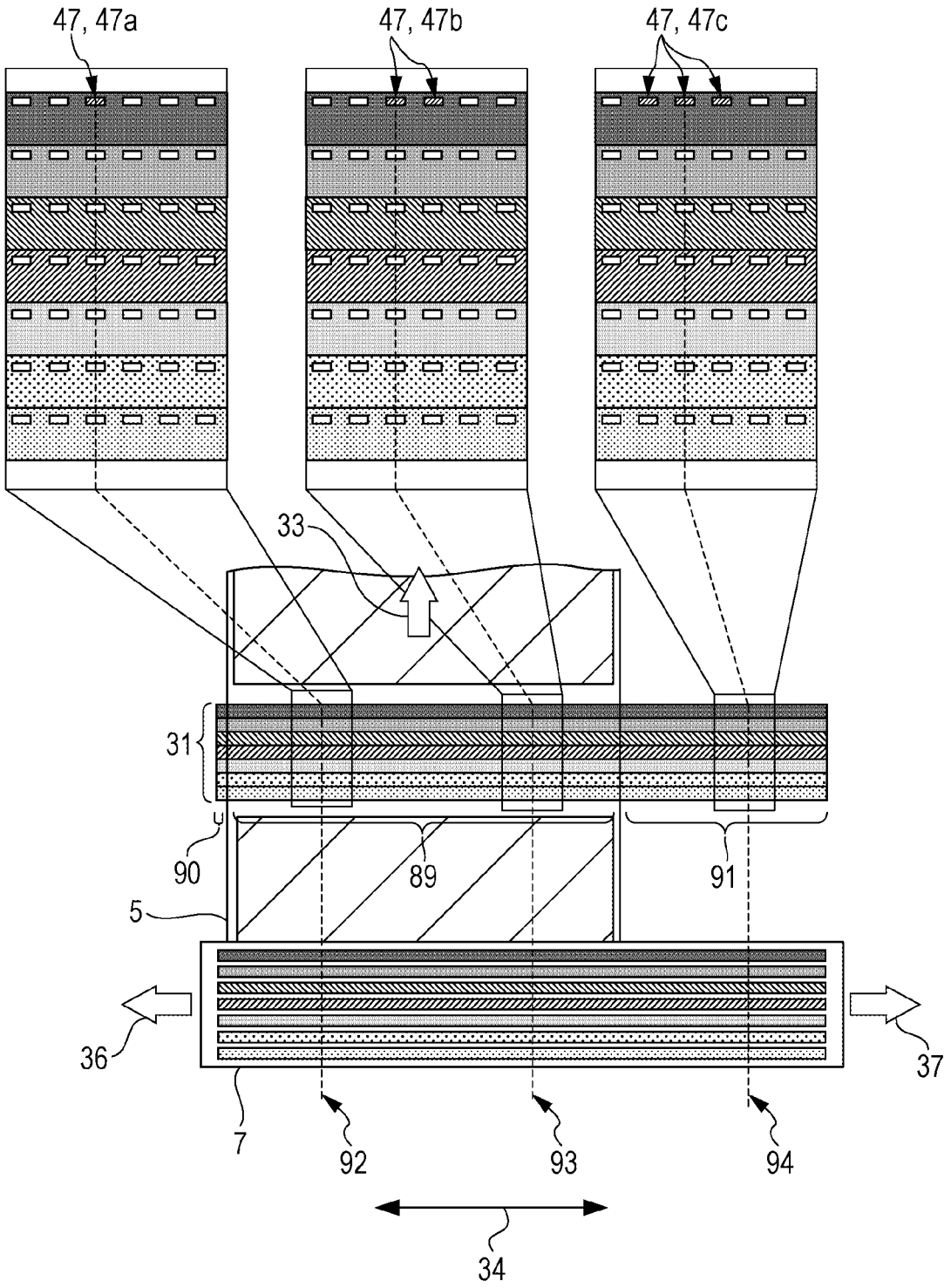
FIG. 11 is a diagram for describing about reference marks in a test pattern.

FIG. 11 is a diagram for describing the placement of reference marks 47, illustrating the test pattern 31 recorded on the recording medium 5. In the test pattern 31, the region recorded on the recording medium 5 (hereinafter referred to as "test pattern region 89") is the region where faulty discharge analysis is performed. Test pattern regions 90 and 91 are regions off of the recording medium 5, and no printing region thereof is made on the recording medium 5.

The recording head unit 7 sequentially moves in the head main scanning direction 34 to use nozzles of the entire region. There are at least two reference marks 47 positioned in the head main scanning direction 34 as shown in FIG. 11, so that at least one reference mark 47 will be recorded on the recording medium 5 regardless of what position the recording head unit 7 is as to the recording medium 5. With the present embodiment, there are positioned three reference marks 47*a*, 47*b*, and 47*c* in the recordable range of the recording head unit 7. Identification of the three reference marks is made by the number of reference marks 47 continuous in the head main scanning direction 34.

The first reference mark 47*a* is a reference mark 47 corresponding to the head position 92. That is to say, this is a position corresponding to the landing position of the ink discharged from the nozzle at head position 92. The first reference mark 47*a* is formed by placing one reference mark 47, and the center position of the reference mark 47 as to the head main scanning direction 34 is the reference position.

The second reference mark 47*b* is reference marks 47 corresponding to the head position 93. The second reference mark 47*b* is formed by placing two reference marks 47 consecutively in the head main scanning direction 34, and the center position of one reference mark 47 as to the head main scanning direction 34 is the reference position.

The third reference mark 47*c* is reference marks 47 corresponding to the head position 94. The third reference mark 47*c* is formed by placing three reference marks 47 consecutively in the head main scanning direction 34, and the center position of the middle reference mark 47 as to the head main scanning direction 34 is the reference position. Nozzles in each of the head positions discharge ink so as to land ink at positions not at the side edges of the pattern actually recorded on the recording medium 5.

Figures 12A, 12B, 12C:
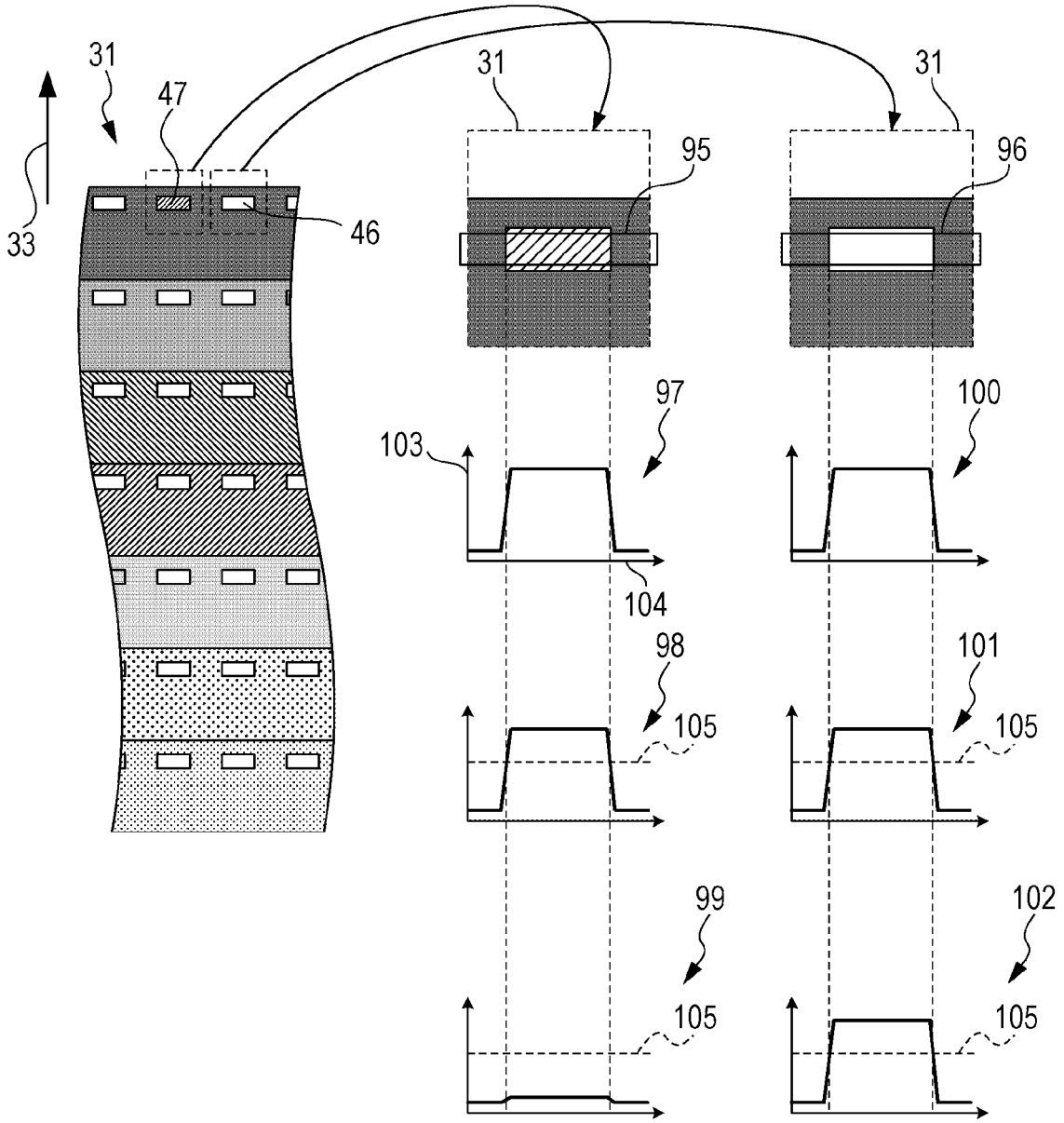
FIGS. 12A through 12C are diagrams for describing processing for detecting reference marks in a test pattern.

FIGS. 12A through 12C are diagrams for describing the processing for detecting the reference marks 47 of the recording head unit 7. FIG. 12A is a partial diagram of the test pattern 31 including the reference marks 47, FIG. 12B is a diagram showing around a reference mark 47 enlarged, and FIG. 12C is a diagram showing around a position mark 46 enlarged.

In order to detect a reference mark 47, detection is performed based on the luminance value of the R, G, and B channels in the blank region of a detected position mark 46. With the present embodiment, the reference marks 47 and position marks 46 are of the same shape, just the recording colors are different. Accordingly, checking the luminance values of predetermined channels from the position mark 46 detected in operation S5 (FIG. 5) allows the reference mark 47 to be detected, thereby reducing the amount of time necessary to detect the reference mark 47.

The reference mark 47 is the blank region of the position mark 46 recorded in solid Y (yellow), so determination of detection is performed by whether or not the luminance value of the B channel of the solid recording region is within a predetermined value. An average luminance region 95 indicates the average luminance value of the reference mark 47 region in the conveyance direction 33 of the recording medium 5 (FIGS. 4A through 4D). An average luminance region 96 indicates the average luminance value of the position mark 46 region in the conveyance direction 33 of the recording medium 5.

Graphs 97 through 99 illustrate the luminance values in the average luminance region 95, with graph 97 illustrating the luminance value of the R channel, graph 98 the G channel, and graph 99 the B channel. Graphs 100 through 102 illustrate the luminance values in the average luminance region 96, with graph 100 illustrating the luminance value of the R channel, graph 101 the G channel, and graph 102 the B channel. In each of the graphs, the Y axis 103 represents the average luminance value, and the X axis 104 represents the average pixel position.

A threshold 105 is a value of luminance value for determining whether the average luminance region is a paper white region or a Y (yellow) solid recording region. The reference mark 47 is detected by having a region wherein the average luminance value of the G channel shown in graph 98 is equal to or greater than the value of the threshold 105, and by having no region wherein the average luminance value of the B channel shown in graph 99 is equal to or greater than the value of the threshold 105.

The position mark 46 is detected by having a region wherein the average luminance value of the G channel shown in graph 101 is equal to or greater than the value of the threshold 105, and by having a region wherein the average luminance value of the B channel shown in graph 102 is equal to or greater than the value of the threshold 105.

Figure 13A:
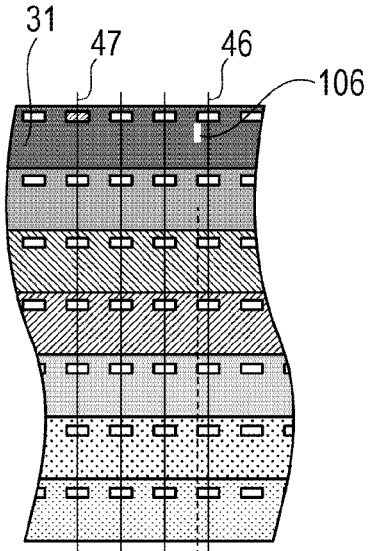
FIGS. 13A and 13B are diagrams for describing processing for performing faulty discharge compensation with nozzles around a faulty discharge nozzle.
Figure 13B:
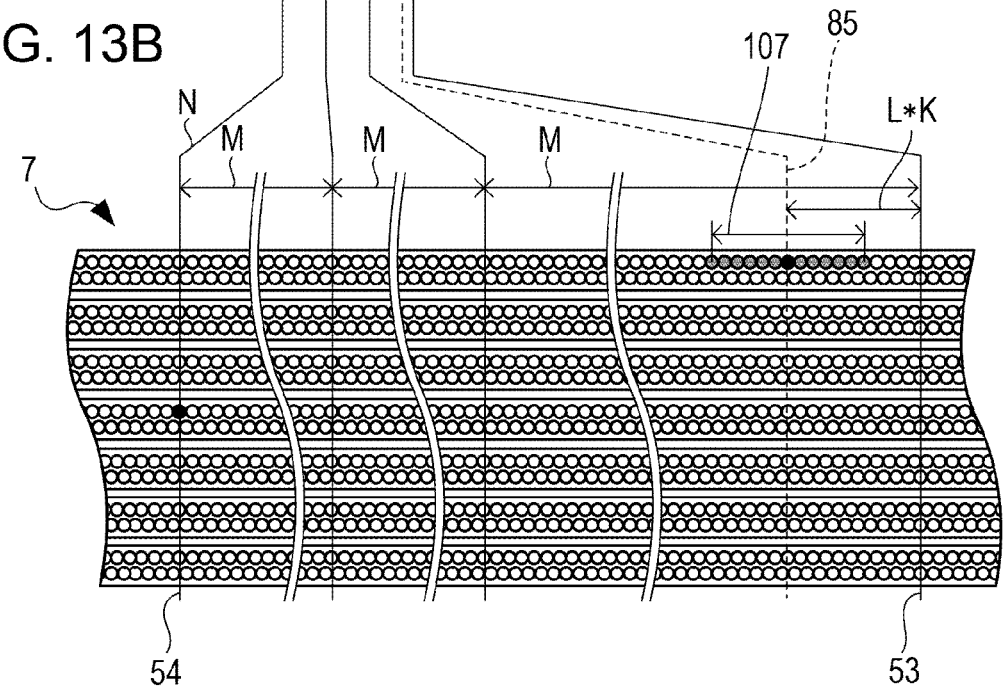

A faulty discharge nozzle position calculating process for calculating the position of a faulty discharge state nozzle from the detected faulty discharge image, for the faulty discharge nozzle 85 (FIGS. 9A through 9D), and faulty discharge complementing processing for the faulty discharge nozzle 85, will be described. FIGS. 13A and 13B are diagrams for describing faulty discharge complementing processing with nozzles in a predetermined range around the faulty discharge nozzle 85. FIG. 13A is a partial diagram of the test pattern 31 including reference marks 47 and a faulty discharge image 106, and FIG. 13B is an enlarged diagram of the recording head unit 7 which has recorded the test pattern 31 shown in FIG. 13A.

First, in the faulty discharge complementing processing, a reference mark 47 is detected. Detection of reference marks 47 is performed by performing processing for detecting reference marks 47 at all position marks 46. Next, the position mark 46 in closest proximity to the faulty discharge image 106 is detected.

Subsequently, the reference position 53 of the position mark 46 in closest proximity to the faulty discharge image 106 at the recording head unit 7 is identified. With the present embodiment, the third position mark 46 from the reference mark 47 is the position mark 46 in closest proximity to the faulty discharge image 106. Accordingly, with the reference position 55 of the reference mark 47 as N, and the distance to the adjacent position marks 46 as M nozzles, the reference position 53 of the position mark 46 is N+(M*3).

Next, the nozzle position in the recording head unit 7 which has formed the faulty discharge image 106 is identified. With the distance between the faulty discharge image 106 and the position mark 46 as L pixels in the read image, and the length of one pixel as K nozzles, the position of the faulty discharge nozzle 85 in the recording head unit 7 is N+(M*3)+(L*K). With the present embodiment, the faulty discharge image 106 is on the reference mark 47 side of the reference position 53 of the position mark 46, so the value of L is a negative value.

At the time of obtaining the position of the faulty discharge nozzle 85, an arrangement may be made where the number of pixels from the reference mark 47 to the faulty discharge image 106 is detected, and this number of pixels is multiplied by the number of nozzles per pixel. In the event that the dimensions of the read image may shrink when reading the test pattern 31 as compared to the dimensions of the test pattern 31 recorded on the recording medium 5, the faulty discharge nozzle 85 may be detected more precisely by obtaining the position of the faulty discharge nozzle 85 using the multiple position marks 46 provided on the recording medium 5. Obtaining the distance to the faulty discharge 106 using the position mark 46 closer by will reduce the effects of shrinkage.

Next, nozzles in a predetermined range around the identified faulty discharge nozzle 85 perform faulty discharge complementing processing. The position of the identified faulty discharge nozzle 85 may be off, so faulty discharge complementing is performed not only for the identified faulty discharge nozzle 85, but for nozzles in a predetermined range. Causes of being off include the resolution of the read image to be analyzed being lower than the resolution of the nozzle array, so the faulty discharge nozzle may not be identified in increments of nozzles, and the read image being warped in the head main scanning direction 34 due to various distortions of the recording medium 5 at the time of reading with the scanner.

If we say that the predetermined amount for faulty discharge complementing is 13 nozzles, this means that nozzles with nozzle positions N+(M*3)−6 through N+(M*3)+(L*K)+6 are faulty discharge complementing object nozzles 107.

Thus, even when recording a test pattern 31 with borderless recording, the positional relation between the recording medium 5 and the recording head 8 may be identified by including reference marks 47 in the test pattern 31. Consequently, the position of the faulty discharge nozzle may be detected.

Also, faulty discharge complementing control may be performed in which normal nozzles perform substitute droplet discharge for the faulty discharge nozzle, by detecting the position of the faulty discharge nozzle. Performing faulty discharge complementing allows the ink jet recording apparatus to continue recording operations without stopping by avoiding the faulty discharge nozzle.

Note that embodiments of the present invention may also be applicable to a test pattern 31 recorded with a border, as well.

Disclosed aspects of the embodiments may be realized by an apparatus, a machine, a method, a process, or an article of manufacture. The method may be a computerized method to perform the operations with the use of a computer, a machine, a processor, or a programmable device. The operations in the method involve physical objects or entities representing a machine or a particular apparatus (e.g., an ink jet recording apparatus, a recording head, a recording medium). In addition, the operations in the method transform the elements or parts from one state to another state. The transformation is particularized and focused on detecting faulty discharge of nozzles in an ink jet recording apparatus. The transformation provides a different function or use such as detecting reference marks and detecting the position of nozzles in a faulty discharge state from the position of the faulty discharge image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image processing apparatus configured to print an image on a printing medium using a printing head having at least a first nozzle array in which a plurality of first nozzles for discharging first color ink is arrayed in an arraying direction and a second nozzle array in which a plurality of second nozzles for discharging second color ink which is different from the first color ink is arrayed in the arranging direction, the image processing apparatus comprising:

a first obtaining unit configured to obtain, based on a result of reading a test pattern comprising a pattern image printed on the printing medium by using the first nozzles and a first mark printed on the printing medium by using a part of the second nozzle, first information indicating the first mark and second information indicating a distance between the first mark indicated in the first information and a faulty region within the pattern image;

a second obtaining unit configured to obtain third information indicating a part of first nozzles corresponding to the part of second nozzles used for printing the first mark based on the first information obtained by the first obtaining unit; and an identifying unit configured to identify, from among the first nozzles used for printing the pattern image, a first nozzle corresponding to the faulty region based on the second information obtained by the first obtaining unit and the third information obtained by the second obtaining unit.

2. The image processing apparatus according to claim 1, wherein, the test pattern further comprises a plurality of the first marks each of which is printed on the printing medium by using a different one of parts of the second nozzles, and wherein the first obtaining unit obtains the first information indicating the first mark closest to the faulty region in the arranging direction among the plurality of first marks.

3. The image processing apparatus according to claim 2, wherein the test pattern further comprises a plurality of second marks formed by not discharging the first color ink and the second color ink within the pattern image, wherein the image processing apparatus further comprises a third obtaining unit configured to obtain fourth information indicating a number of the second marks between the faulty region and the first mark closest to the faulty region in the arranging direction, and wherein the first obtaining unit obtains the second information based on the fourth information obtained by the third obtaining unit.

4. The image processing apparatus according to claim 3, wherein, among the plurality of first nozzles arrayed in the printing head, the first nozzles corresponding respectively to the plurality of first marks and the plurality of second marks are not disposed adjacent to one another.

5. The image processing apparatus according to claim 3, wherein the plurality of first marks and the plurality of second marks are disposed at equal intervals each other.

6. The image processing apparatus according to claim 3, further comprising a fourth obtaining unit configured to obtain fifth information indicating a distance between the faulty region and a second mark closest to the faulty region in the arranging direction, wherein the first obtaining unit obtains the second information based on the fourth information obtained by the third obtaining unit and the fifth information obtained by the fourth obtaining unit.

7. The image processing apparatus according to claim 2, wherein one of the plurality of the first mark is printed on the printing medium by using a first number of the second nozzles, and other of the plurality of the first mark is printed on the printing medium by using a second number, which is larger than the first number, of the second nozzles.

8. The image processing apparatus according to claim 1, wherein the distance indicated in the second information is a distance between a first nozzle corresponding to a center position in the arraying direction of the first mark indicated in the first information and the faulty region.

9. The image processing apparatus according to claim 1, wherein a length over which the printing head is able to print in the arraying direction is longer than a width in the arraying direction of the printing medium.

10. The image processing apparatus according to claim 1, further comprising a reading unit configured to read the pattern image and the first mark.

11. The image processing apparatus according to claim 1, further comprising a control unit configured to cause the printing head to print an image, which is to be printed using the first nozzle identified by the identifying unit as corresponding to the faulty region, using a nozzle which does not correspond to the faulty region.

12. The image processing apparatus according to claim 1, wherein the first mark is printed on the printing medium within the pattern image.

* * * * *